US011107381B2

(12) United States Patent
Wang et al.

(10) Patent No.: US 11,107,381 B2
(45) Date of Patent: Aug. 31, 2021

(54) SHIFT REGISTER AND METHOD FOR DRIVING THE SAME, GATE DRIVING CIRCUIT AND DISPLAY DEVICE

(71) Applicants: HEFEI BOE OPTOELECTRONICS TECHNOLOGY CO., LTD., Anhui (CN); BOE TECHNOLOGY GROUP CO., LTD., Beijing (CN)

(72) Inventors: Ying Wang, Beijing (CN); Meng Li, Beijing (CN); Jing Li, Beijing (CN); Hongmin Li, Beijing (CN)

(73) Assignees: HEFEI BOE OPTOELECTRONICS TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/839,858

(22) Filed: Apr. 3, 2020

(65) Prior Publication Data

US 2021/0134203 A1 May 6, 2021

(30) Foreign Application Priority Data

Oct. 31, 2019 (CN) ..... 201911053324.0

(51) Int. Cl.
*G09G 3/20* (2006.01)

(52) U.S. Cl.
CPC ..... *G09G 3/20* (2013.01); *G09G 2300/0408* (2013.01); *G09G 2300/0426* (2013.01); *G09G 2300/08* (2013.01); *G09G 2310/0267* (2013.01); *G09G 2310/0286* (2013.01); *G09G 2310/08* (2013.01)

(58) Field of Classification Search
CPC ..... G09G 2310/0286; G09G 3/20; G09G 3/3266; G09G 3/3674; G09G 2310/0291; G09G 2310/08; G09G 3/3677; G09G 2310/0267; G09G 2330/02; G09G 2330/021; G09G 3/3225; G11C 19/28; G11C 19/287
See application file for complete search history.

(56) References Cited

U.S. PATENT DOCUMENTS 7,283,603 B1 * 10/2007 Chien ..... G11C 19/00 345/100
2006/0238482 A1 * 10/2006 Jang ..... G11C 19/28 345/100

(Continued)

*Primary Examiner* — Ram A Mistry
(74) *Attorney, Agent, or Firm* — Brooks Kushman P.C.

(57) ABSTRACT

A shift register, a method for driving the same, a gate driving circuit and a display device are provided. The shift register includes an input sub-circuit, an output sub-circuit, a reset sub-circuit, and a first shift output sub-circuit to an m-th shift output sub-circuit. The i-th shift output sub-circuit is connected with a third node, an (i−1)-th shift node, an i-th shift node, an (i+1)-th clock signal terminal, a first power terminal, a second power terminal, an (i−1)-th shift signal output terminal and an i-th shift signal output terminal, and is configured to supply a signal of the first power terminal to the i-th shift signal output terminal and a signal of the second power terminal to the (i−1)-th shift signal output terminal and the (i−1)-th shift node under control of the (i+1)-th clock signal terminal, i being an integer between 2 and m.

20 Claims, 11 Drawing Sheets

(56) References Cited

U.S. PATENT DOCUMENTS

| | | | | |
|---|---|---|---|---|
| 2008/0258998 | A1* | 10/2008 | Miyake | H01L 27/1251 345/42 |
| 2012/0081409 | A1* | 4/2012 | Chung | G09G 3/3677 345/690 |
| 2014/0168044 | A1* | 6/2014 | Hu | G09G 3/3696 345/90 |

* cited by examiner

SHIFT REGISTER AND METHOD FOR DRIVING THE SAME, GATE DRIVING CIRCUIT AND DISPLAY DEVICE

CROSS-REFERENCE TO RELATED APPLICATION

This application claims priority to Chinese Patent Application No. 201911053324.0 filed on Oct. 31, 2019, which is incorporated herein by reference in its entirety.

TECHNICAL FIELD

The present disclosure relates to the field of display technology, in particular to a shift register and a method for driving the same, a gate driving circuit and a display device.

BACKGROUND

In recent years, flat panel displays, such as thin film transistor liquid crystal display (TFT-LCD) panels and active matrix organic light emitting diode (AMOLED) display panels, are widely applied in televisions (TVs), mobile phones and other electronic products, due to their advantages of being thin and light and having a low power consumption.

With the advancement of technology, high-resolution and narrow-frame display panels have become a development trend. Accordingly, Gate Driver on Array (GOA) technology has emerged. The GOA technology refers to that a GOA circuit for driving gate lines is disposed on both sides of an effective display area of an array substrate in a display panel, where the GOA circuit includes a plurality of shift registers.

SUMMARY

In a first aspect, a shift register is provided according to embodiments of the present disclosure, which includes an input sub-circuit, an output sub-circuit, a reset sub-circuit, and a first shift output sub-circuit to an m-th shift output sub-circuit, m being an integer greater than or equal to 2, where:

the input sub-circuit is connected with a first signal input terminal, a first clock signal terminal, a first node, a second node and a first power terminal, and is configured to supply a signal of the first signal input terminal to the first node under control of the first clock signal terminal;

the output sub-circuit is connected with a second signal input terminal, a first signal output terminal, the first node, a third node and a second power terminal, and is configured to output a signal of the first node to the third node and a signal of the second signal input terminal to the first signal output terminal under control of the first node;

the reset sub-circuit is connected with the first node, the second node, the third node, an m-th shift node, the second power terminal, an m-th shift signal output terminal and a third signal input terminal, and is configured to supply a signal of the second power terminal to the first node, the third node, the m-th shift node, and the m-th shift signal output terminal under control of the third signal input terminal;

the first shift output sub-circuit is connected with the third node, the first shift node, a second clock signal terminal, the first power terminal, and a first shift signal output terminal, and is configured to output a signal of the first power terminal to the first shift signal output terminal under control of the second clock signal terminal and in response to a signal of the third node; and an i-th shift output sub-circuit is connected with the third node, an (i−1)-th shift node, an i-th shift node, an (i+1)-th clock signal terminal, the first power terminal, the second power terminal, an (i−1)-th shift signal output terminal and an i-th shift signal output terminal, and is configured to output the signal of the first power terminal to the i-th shift signal output terminal under control of the (i+1)-th clock signal terminal and in response to the signal of the third node, and supply the signal of the second power terminal to the (i−1)-th shift signal output terminal and the (i−1)-th shift node under control of the (i+1)-th clock signal terminal, where i is an integer that is greater than or equal to 2 and less than or equal to m.

In some optional embodiments, the input sub-circuit includes: a first transistor, a second transistor, and a third transistor, where:

a gate electrode of the first transistor is connected with the first clock signal terminal, a first electrode of the first transistor is connected with the first signal input terminal, and a second electrode of the first transistor is connected with the second node;

a gate electrode of the second transistor is connected with the first clock signal terminal, a first electrode of the second transistor is connected with the second node, and a second electrode of the second transistor is connected with the first node; and a gate electrode of the third transistor is connected with the first node, a first electrode of the third transistor is connected with the first power terminal, and a second electrode of the third transistor is connected with the second node.

In some optional embodiments, the output sub-circuit includes: a fourth transistor, a fifth transistor, a first capacitor, and a second capacitor, where:

a gate electrode of the fourth transistor is connected with the first node, a first electrode of the fourth transistor is connected with the second signal input terminal, and a second electrode of the fourth transistor is connected with the first signal output terminal;

a gate electrode and a first electrode of the fifth transistor are connected with the first node, and a second electrode of the fifth transistor is connected with the third node;

one end of the first capacitor is connected with the first node, and the other end of the first capacitor is connected with the first signal output terminal; and one end of the second capacitor is connected with the third node, and the other end of the second capacitor is connected with the second power terminal.

In some optional embodiments, the reset sub-circuit includes: a sixth transistor, a seventh transistor, an eighth transistor, a ninth transistor, and a tenth transistor, where:

a gate electrode of the sixth transistor is connected with the third signal input terminal, a first electrode of the sixth transistor is connected with the first node, and a second electrode of the sixth transistor is connected with the second node;

a gate electrode of the seventh transistor is connected with the third signal input terminal, a first electrode of the seventh transistor is connected with the second node, and a second electrode of the seventh transistor is connected with the second power terminal;

a gate electrode of the eighth transistor is connected with the third signal input terminal, a first electrode of the eighth transistor is connected with the third node, and a second electrode of the eighth transistor is connected with the second power terminal;

a gate electrode of the ninth transistor is connected with the third signal input terminal, a first electrode of the ninth transistor is connected with the m-th shift node, and a second electrode of the ninth transistor is connected with the second power terminal; and a gate electrode of the tenth transistor is connected with the third signal input terminal, a first electrode of the tenth transistor is connected with the m-th shift signal output terminal, and a second electrode of the tenth transistor is connected with the second power terminal.

In some optional embodiments, the first shift output sub-circuit includes: an eleventh transistor and a twelfth transistor, where:

a gate electrode of the eleventh transistor is connected with the second clock signal terminal, a first electrode of the eleventh transistor is connected with the third node, and a second electrode of the eleventh transistor is connected with the first shift node; and a gate electrode of the twelfth transistor is connected with the first shift node, a first electrode of the twelfth transistor is connected with the first power terminal, and a second electrode of the twelfth transistor is connected with the first shift signal output terminal.

In some optional embodiments, the i-th shift output sub-circuit includes: a thirteenth transistor, a fourteenth transistor, a fifteenth transistor, and a sixteenth transistor, where:

a gate electrode of the thirteenth transistor is connected with the (i+1)-th clock signal terminal, a first electrode of the thirteenth transistor is connected with the (i−1)-th shift node, and a second electrode of the thirteenth transistor is connected with the second power terminal;

a gate electrode of the fourteenth transistor is connected with the (i+1)-th clock signal terminal, a first electrode of the fourteenth transistor is connected with the (i−1)-th shift signal output terminal, and a second electrode of the fourteenth transistor is connected with the second power terminal;

a gate electrode of the fifteenth transistor is connected with the (i+1)-th clock signal terminal, a first electrode of the fifteenth transistor is connected with the third node, and a second electrode of the fifteenth transistor is connected with the i-th shift node; and a gate electrode of the sixteenth transistor is connected with the i-th shift node, a first electrode of the sixteenth transistor is connected with the i-th shift signal output terminal, and a second electrode of the sixteenth transistor is connected with the first power terminal.

In some optional embodiments, the input sub-circuit includes a first transistor, a second transistor and a third transistor, the output sub-circuit includes a fourth transistor, a fifth transistor, a first capacitor and a second capacitor, the reset sub-circuit includes a sixth transistor, a seventh transistor, an eighth transistor, a ninth transistor and a tenth transistor, the first shift output sub-circuit includes an eleventh transistor and a twelfth transistor, and the i-th shift output sub-circuit includes a thirteenth transistor, a fourteenth transistor, a fifteenth transistor and a sixteenth transistor, where:

a gate electrode of the first transistor is connected with the first clock signal terminal, a first electrode of the first transistor is connected with the first signal input terminal, and a second electrode of the first transistor is connected with the second node;

a gate electrode of the second transistor is connected with the first clock signal terminal, a first electrode of the second transistor is connected with the second node, and a second electrode of the second transistor is connected with the first node;

a gate electrode of the third transistor is connected with the first node, a first electrode of the third transistor is connected with the first power terminal, and a second electrode of the third transistor is connected with the second node;

a gate electrode of the fourth transistor is connected with the first node, a first electrode of the fourth transistor is connected with the second signal input terminal, and a second electrode of the fourth transistor is connected with the first signal output terminal;

a gate electrode and a first electrode of the fifth transistor are connected with the first node, and a second electrode of the fifth transistor is connected with the third node;

one end of the first capacitor is connected with the first node, and the other end of the first capacitor is connected with the first signal output terminal;

one end of the second capacitor is connected with the third node, and the other end of the second capacitor is connected with the second power terminal;

a gate electrode of the sixth transistor is connected with the third signal input terminal, a first electrode of the sixth transistor is connected with the first node, and a second electrode of the sixth transistor is connected with the second node;

a gate electrode of the seventh transistor is connected with the third signal input terminal, a first electrode of the seventh transistor is connected with the second node, and a second electrode of the seventh transistor is connected with the second power terminal;

a gate electrode of the eighth transistor is connected with the third signal input terminal, a first electrode of the eighth transistor is connected with the third node, and a second electrode of the eighth transistor is connected with the second power terminal;

a gate electrode of the ninth transistor is connected with the third signal input terminal, a first electrode of the ninth transistor is connected with the m-th shift node, and a second electrode of the ninth transistor is connected with the second power terminal;

a gate electrode of the tenth transistor is connected with the third signal input terminal, a first electrode of the tenth transistor is connected with the m-th shift signal output terminal, and a second electrode of the tenth transistor is connected with the second power terminal;

a gate electrode of the eleventh transistor is connected with the second clock signal terminal, a first electrode of the eleventh transistor is connected with the third node, and a second electrode of the eleventh transistor is connected with the first shift node;

a gate electrode of the twelfth transistor is connected with the first shift node, a first electrode of the twelfth transistor is connected with the first power terminal, and a second electrode of the twelfth transistor is connected with the first shift signal output terminal;

a gate electrode of the thirteenth transistor is connected with the (i+1)-th clock signal terminal, a first electrode of the thirteenth transistor is connected with the (i−1)-th shift node, and a second electrode of the thirteenth transistor is connected with the second power terminal;

a gate electrode of the fourteenth transistor is connected with the (i+1)-th clock signal terminal, a first electrode of the fourteenth transistor is connected with the (i−1)-th shift signal output terminal, and a second electrode of the fourteenth transistor is connected with the second power terminal;

a gate electrode of the fifteenth transistor is connected with the (i+1)-th clock signal terminal, a first electrode of the fifteenth transistor is connected with the third node, and a second electrode of the fifteenth transistor is connected with the i-th shift node; and a gate electrode of the sixteenth transistor is connected with the i-th shift node, a first electrode of the sixteenth transistor is connected with the i-th shift signal output terminal, and a second electrode of the sixteenth transistor is connected with the first power terminal.

In some optional embodiments, all the first transistor to the sixteenth transistor are N-type thin film transistors; or all the first transistor to the sixteenth transistor are P-type thin film transistors.

In some optional embodiments, a frequency of a pulse signal inputted into the second signal input terminal is m times of a frequency of each signal inputted into the first clock signal terminal to the (i+1)-th clock signal terminal.

In a second aspect, a gate driving circuit is further provided according to embodiments of the present disclosure, including: a plurality of cascaded shift registers as described in the above embodiments; where:

a first signal input terminal of a first stage of the shift registers is connected with an initial signal input terminal, and a first signal input terminal of an (N+1)-th stage of the shift registers is connected with a first signal output terminal of an N-th stage of the shift registers, N being an integer greater than or equal to 1;

a second signal input terminal of an odd-numbered stage of the shift registers is connected with an external first input terminal, and a second signal input terminal of an even-numbered stage of the shift registers is connected with an external second input terminal;

a third signal input terminal of the N-th stage shift register is connected with a first shift signal output terminal of the (N+1)-th stage shift register;

a first clock signal terminal of the odd-numbered stage shift register is connected with an external first clock signal line, a second clock signal terminal of the odd-numbered stage shift register is connected with an external second clock signal line, and a third clock signal terminal of the odd-numbered stage shift register is connected with an external third clock signal line;

a first clock signal terminal of the even-numbered stage shift register is connected with the external third clock signal line, a second clock signal terminal of the even-numbered stage shift register is connected with an external fourth clock signal line, and a third clock signal terminal of the even-numbered stage shift register is connected with the external first clock signal line; and signals inputted into the first input terminal and the second input terminal are pulse signals with opposite phases, frequencies of the signals inputted into the first input terminal and the second input terminal are both f and a frequency of each clock signal inputted into the first clock signal line, the second clock signal line, the third clock signal line and the fourth clock signal line is m*f, where m is the number of stages of outputs of the shift output sub-circuit included in each stage of the shift registers.

In a third aspect, a method for driving a shift register is further provided according to embodiments of the present disclosure, which is applied to the shift register as described above. The method includes:

supplying, by the input sub-circuit, the signal of the first signal input terminal to the first node under control of the first clock signal terminal;

supplying, by the output sub-circuit, the signal of the first node to the third node and outputting the signal of the second signal input terminal to the first signal output terminal under control of the first node;

outputting, by the first shift output sub-circuit, the signal of the first power terminal to the first shift signal output terminal under control of the second clock signal terminal;

taking a value of i from 2 to m in sequence and executing processes: outputting, by the i-th shift output sub-circuit, the signal of the first power terminal to the i-th shift signal output terminal, and supplying the signal of the second power terminal to the (i−1)-th shift signal output terminal and the (i−1)-th shift node under control of the (i+1)-th clock signal terminal; and supplying, by the reset sub-circuit, the signal of the second power terminal to the first node, the third node, the m-th shift node, and the m-th shift signal output terminal under control of the third signal input terminal.

In some optional embodiments, the method further includes:

in a first period, inputting a first-level signal to the first signal input terminal and the first clock signal terminal so that a potential of the first node and a potential of the second node are pulled to a first level by the input sub-circuit;

in a second period, inputting a first-level signal to the second signal input terminal and the second clock signal terminal, so that the first level is outputted to the first signal output terminal by the output sub-circuit in response to the potential of the first node, and a first level of the first power terminal is outputted to the first shift signal output terminal by the output sub-circuit in response to a potential of the third node;

in a third period, taking a value of i from 2 to m sequentially and executing processes: inputting a first-level signal to the second signal input terminal and the (i+1)-th clock signal terminal, so that the i-th output sub-circuit outputs a first level of the first power terminal to the i-th shift signal output terminal, and transmits a second level of the second power terminal to the (i−1)-th shift node; and in a fourth period, inputting a first-level signal to the third signal input terminal, so that potentials of the first node, the third node, the m-th shift node and the m-th shift signal output terminal are pulled to the second level of the second power terminal by the reset sub-circuit.

In a fourth aspect, a display device is further provided according to embodiments of the present disclosure, which includes the gate driving circuit as described above.

Other features and advantages of the present disclosure will be explained in the following description, part of which becomes apparent from the description, or may be obtained by implementing the present disclosure. Other advantages of the present disclosure can be realized and obtained by schemes described in the description, claims and drawings.

BRIEF DESCRIPTION OF THE DRAWINGS

The drawings are used to illustrate a technical solution of the present disclosure, and constitute a part of the present disclosure. The technical solution of the present disclosure is explained by the drawings together with embodiments of the present disclosure, which do not constitute a limitation to the technical solutions of the present disclosure.

DETAILED DESCRIPTION

In order to make objectives, technical solutions, and advantages of the present disclosure clearer, embodiments of the present disclosure will be described in detail below with reference to the accompanying drawings. It should be noted that, in the case of no conflict, the embodiments in the present disclosure and the features in the embodiments can be arbitrarily combined with each other.

Unless otherwise defined, technical terms or scientific terms used in the present disclosure should be interpreted according to common meanings thereof as commonly understood by those of ordinary skills in the art. Such terms as "first", "second" and the like used in the present disclosure do not represent any order, quantity or importance, but are merely used to distinguish different components. Such terms as "including", or "comprising" and the like mean that an element or an article preceding the term contains elements or items and equivalents thereof behind the term, but does not exclude other elements or items.

It can be understood that, each of transistors provided in the embodiments of the present disclosure may be a thin film transistor, or a field effect transistor, or other devices having the same characteristics. Optionally, the thin film transistor provided in the embodiments of the present disclosure may be an oxide semiconductor transistor. Since a source electrode and a drain electrode of the thin film transistor provided herein are symmetrical, the source electrode and the drain electrode thereof can be interchanged. In the embodiments of the present disclosure, in order to distinguish two electrodes of a transistor except the gate, one of the source electrode and the drain electrode is referred to as a first electrode, and the other one of the source electrode and the drain electrode is referred to as a second electrode. That is, the first electrode may be a source electrode or a drain electrode, and the second electrode may be a drain electrode or a source electrode.

The gate driving circuit in the related technologies mainly implements a shift function through an analog clock (AC) signal. A power consumption of the gate driving circuit is mainly generated by a pull-up transistor. Therefore, an equivalent formula for calculating the power consumption of the gate driving circuit is: $P \approx 2\times(C1+C2)\times V^{*}V\times F$, where C1 is a parasitic capacitance of the pull-up transistor, C2 is a parasitic capacitance between the AC signal line and other signal lines, and V is an amplitude of the AC signal voltage, F being a frequency of the AC signal. Since the size of the pull-up transistor is large, the parasitic capacitance is large, and the power consumption is high.

Embodiments of the present disclosure provide a shift register, a driving method for driving the same, a gate driving circuit, and a display device, which can improve display quality of a display panel.

Figure 1:
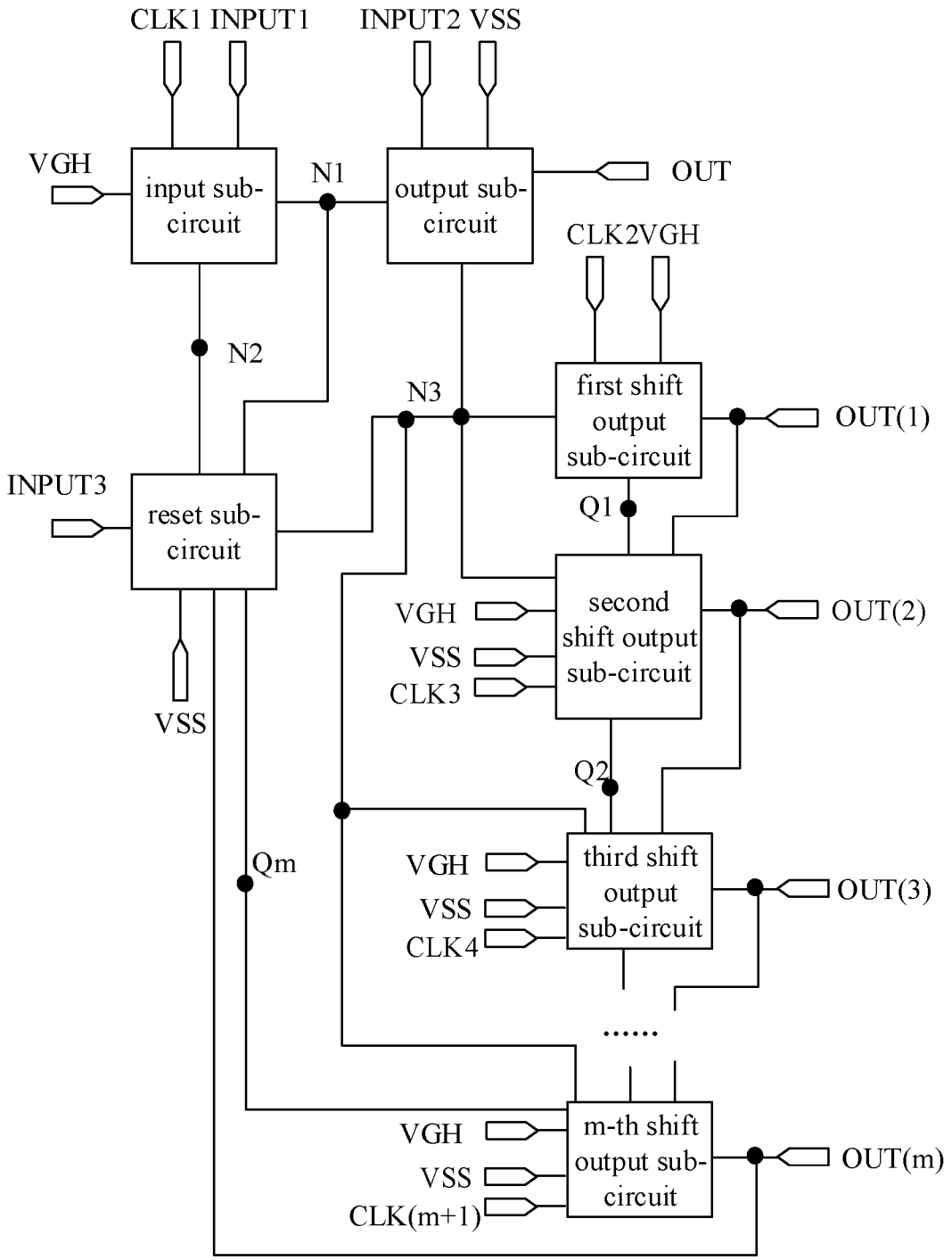
FIG. 1 is a first schematic diagram of an exemplary shift register according to an embodiment of the present disclosure.

Embodiments of the present disclosure provide a shift register. FIG. 1 is a first schematic diagram of a shift register provided by an embodiment of the present disclosure. As shown in FIG. 1, the shift register provided by the embodiment of the present disclosure includes: an input sub-circuit, an output sub-circuit, a reset sub-circuit, and a first output sub-circuit to an m-th shift output sub-circuits, where m is an integer greater than or equal to 2.

Specifically, the input sub-circuit is connected with a first signal input terminal INPUT1, a first clock signal terminal CLK1, a first node N1, a second node N2, and a first power terminal VGH, and is configured to supply a signal at the first signal input terminal INPUT1 to the first node N1 under control of the first clock signal terminal CLK1.

The output sub-circuit is connected with a second signal input terminal INPUT2, a first signal output terminal OUT, a first node N1, a third node N3, and a second power terminal VSS, and is configured to supply a signal at the first node N1 to the third node N3 and supply a signal at the second signal input terminal INPUT2 to the first signal output terminal OUT under control of the first node N1.

The reset sub-circuit is connected with the first node N1, the second node N2, the third node N3, a m-th shift node Qm, the second power terminal VSS, an m-th shift signal output terminal OUT(m), and a third signal input terminal INPUT3, and is configured to supply, under control of the third signal input terminal INPUT3, a signal at the second power terminal VSS to the first node N1, the third node N3, the m-th shift node Qm, and the m-th shift signal output terminal OUT(m).

The first shift output sub-circuit is connected with the third node N3, the first shift node Q1, a second clock signal terminal CLK2, the first power terminal VGH, and a first shift signal output terminal OUT(1), and is configured to supply a signal at the first power terminal VGH to the first shift signal output terminal OUT(1) under action of the third node N3 and under control of the second clock signal terminal CLK2.

The i-th shift output sub-circuit is connected with the third node N3, an (i−1)-th shift node Q(i−1), an i-th shift node Qi, an (i+1)-th clock signal terminal CLK(i+1), the first power terminal VGH, the second power terminal VSS, an (i−1)-th shift signal output terminal OUT(i−1) and an i-th shift signal output terminal OUT(i). The i-th shift output sub-circuit is configured to supply the signal at the first power terminal VGH to the i-th shift signal output terminal OUT(i), and supply the signal at the second power terminal VSS to the (i−1)-th shift signal output terminal OUT(i−1) and the (i−1)-th shift node Q(i−1), under action of the third node N3 and under control of the (i+1)-th clock signal terminal CLK(i+1), where i is an integer between 2 and m.

The shift register in the embodiments of the present disclosure realizes two or more stages of outputs through the first shift output sub-circuit to the m-th shift output sub-circuit, which reduces the size of a frame of a display panel and power consumption of the shift register, thereby improving display quality of the display panel.

Figure 2:
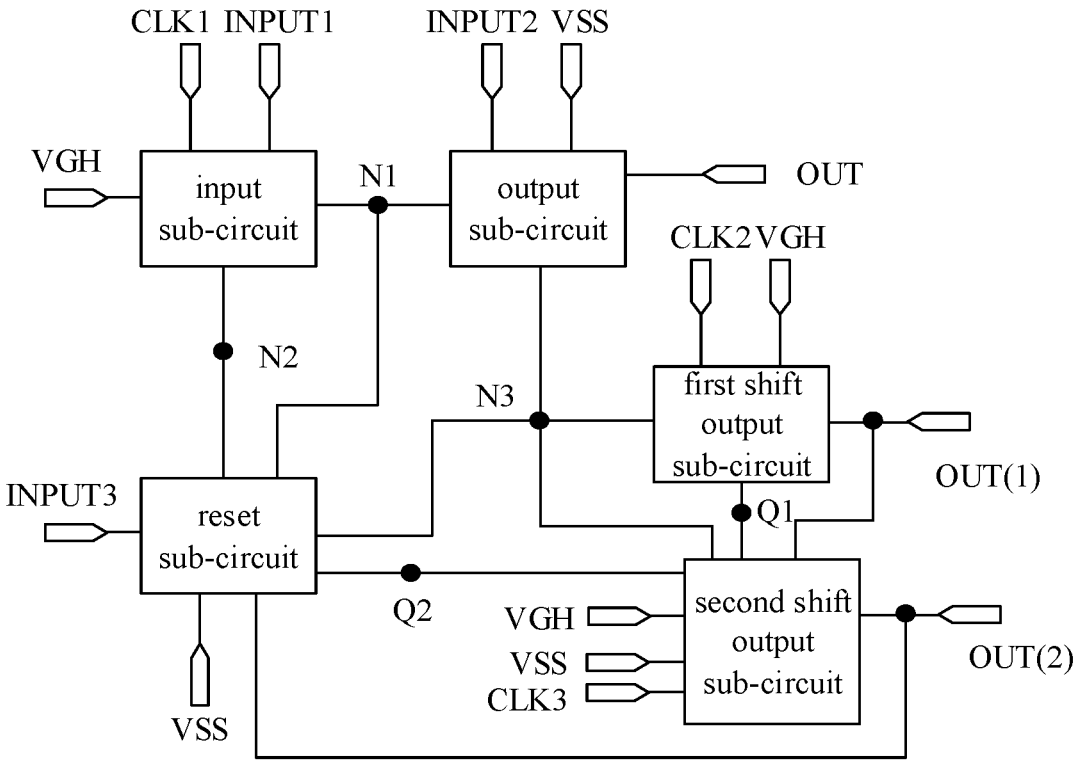
FIG. 2 is a second schematic diagram of an exemplary shift register according to an embodiment of the present disclosure.

In some optional embodiments, as shown in FIG. 2, when m=2, the shift register includes: an input sub-circuit, an output sub-circuit, a reset sub-circuit, a first shift output sub-circuit, and a second shift output sub-circuit.

Specifically, the input sub-circuit is connected with a first signal input terminal INPUT1, a first clock signal terminal CLK1, a first node N1, a second node N2, and a first power terminal VGH, and is configured to supply a signal at the first signal input terminal INPUT1 to the first node N1 under control of the first clock signal terminal CLK1.

The output sub-circuit is connected with a second signal input terminal INPUT2, a first signal output terminal OUT, a first node N1, a third node N3, and a second power terminal VSS, and is configured to supply a signal at the first node N1 to a third node N3 and supply a signal at the second signal input terminal INPUT2 to the first signal output terminal CR(N) under control of the first node N1.

The reset sub-circuit is connected with the first node N1, the second node N2, a third node N3, a second shift node Q2, the second power terminal VSS, a second shift signal output terminal OUT(2), and a third signal input terminal INPUT3, and is configured to supply, under control of the third signal input terminal INPUT3, a signal at the second power terminal VSS to the first node N1, the third node N3, the second shift node Q2 and the second shift signal output terminal OUT(2).

The first shift output sub-circuit is connected with the third node N3, the first shift node Q1, a second clock signal terminal CLK2, the first power terminal VGH, and a first shift signal output terminal OUT(1), and is configured to supply a signal at the first power terminal VGH to the first shift signal output terminal OUT(1) under action of the third node N3 and under control of the second clock signal terminal CLK2.

The second shift output sub-circuit is connected with the third node N3, the first shift node Q1, the second shift node Q2, a third clock signal terminal CLK3, the first power terminal VGH, the second power terminal VSS, and the first shift signal output terminal OUT(1) and a second shift signal output terminal OUT(2), and is configured to supply the signal at the first power terminal VGH to the second shift signal output terminal OUT(2) and supply the signal at the second power terminal VSS to the first shift signal output terminal OUT(1) and the first shift node Q1), under action of the third node N3 and under control of the third clock signal terminal CLK3.

Figure 3:
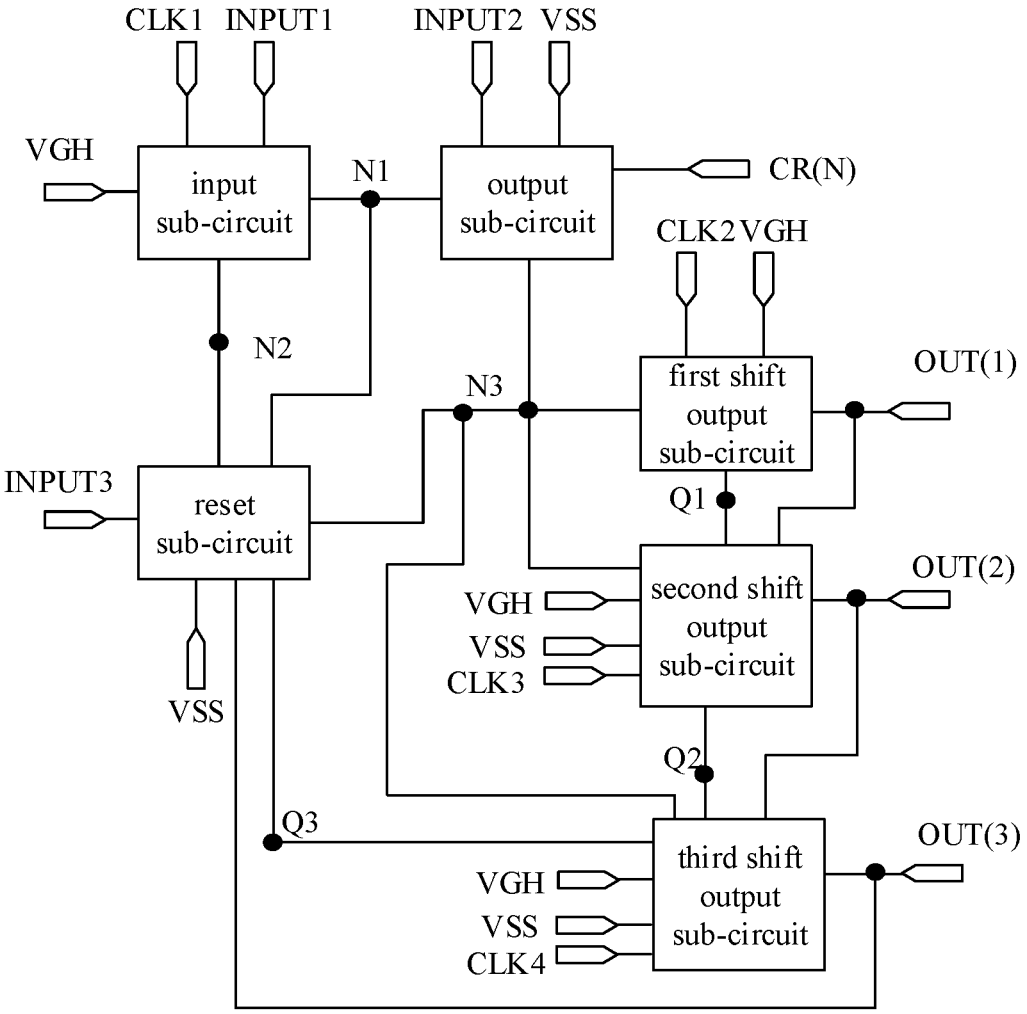
FIG. 3 is a third schematic diagram of an exemplary shift register according to an embodiment of the present disclosure.

The gate driving circuit shown in FIG. 3 realizes two stages of outputs through the above-mentioned first shift output sub-circuit and second shift output sub-circuit, which reduces the size of a frame of a display panel and power consumption of the shift register, thereby improving display quality of the display panel.

In some optional embodiments, as shown in FIG. 3, when m=3, the shift register includes: an input sub-circuit, an output sub-circuit, a reset sub-circuit, a first shift output sub-circuit, a second shift output sub-circuit and a third shift output sub-circuit.

The input sub-circuit is connected with a first signal input terminal INPUT1, a first clock signal terminal CLK1, a first node N1, a second node N2, and a first power terminal VGH, and is configured to supply a signal at the first signal input terminal INPUT1 to the first node N1 under control of the first clock signal terminal CLK1.

The output sub-circuit is connected with a second signal input terminal INPUT2, a first signal output terminal OUT, a first node N1, a third node N3, and a second power terminal VSS, and is configured to supply a signal at the first node N1 to a third node N3 and supply a signal at the second signal input terminal INPUT2 under control of the first node N1.

The reset sub-circuit is connected with the first node N1, the second node N2, a third node N3, a second shift node Q2, the second power terminal VSS, a third shift signal output terminal OUT(3), and a third signal input terminal INPUT3, and is configured to supply, under control of the third signal input terminal INPUT3, a signal at the second power terminal VSS to the first node N1, the third node N3, the second shift node Q2 and the third shift signal output terminal OUT(3).

The first shift output sub-circuit is connected with the third node N3, the first shift node Q1, a second clock signal terminal CLK2, the first power terminal VGH, and a first shift signal output terminal OUT(1), and is configured to supply a signal at the first power terminal VGH to the first shift signal output terminal OUT(1) under action of the third node N3 and under control of the second clock signal terminal CLK2.

The second shift output sub-circuit is connected with the third node N3, the first shift node Q1, the second shift node Q2, a third clock signal terminal CLK3, the first power terminal VGH, the second power terminal VSS, and the first shift signal output terminal OUT(1) and a second shift signal output terminal OUT(2), and is configured to supply the signal at the first power terminal VGH to the second shift signal output terminal OUT(2) and supply the signal at the second power terminal VSS to the first shift signal output terminal OUT(1) and the first shift node Q1, under action of the third node N3 and under control of the third clock signal terminal CLK3.

The third shift output sub-circuit is connected with the third node N3, the second shift node Q2, a third shift node Q3, a fourth clock signal terminal CLK4, the first power terminal VGH, the second power terminal VSS, the second shift signal output terminal OUT(2) and a third shift signal output terminal OUT(3). The third shift output sub-circuit is configured to supply the signal at the first power terminal VGH to the third shift signal output terminal OUT(3), and supply the signal at the second power terminal VSS to the second shift signal output terminal OUT(2) and the second shift node Q2, under action of the third node N3 and under control of the fourth clock signal terminal CLK4.

The gate driving circuit shown in FIG. 3 realizes three stages of outputs through the above-mentioned first shift output sub-circuit, second shift output sub-circuit, and third shift output sub-circuit, which reduces the size of a frame of a display panel and power consumption of the shift register, thereby improving display quality of the display panel.

Figure 4:
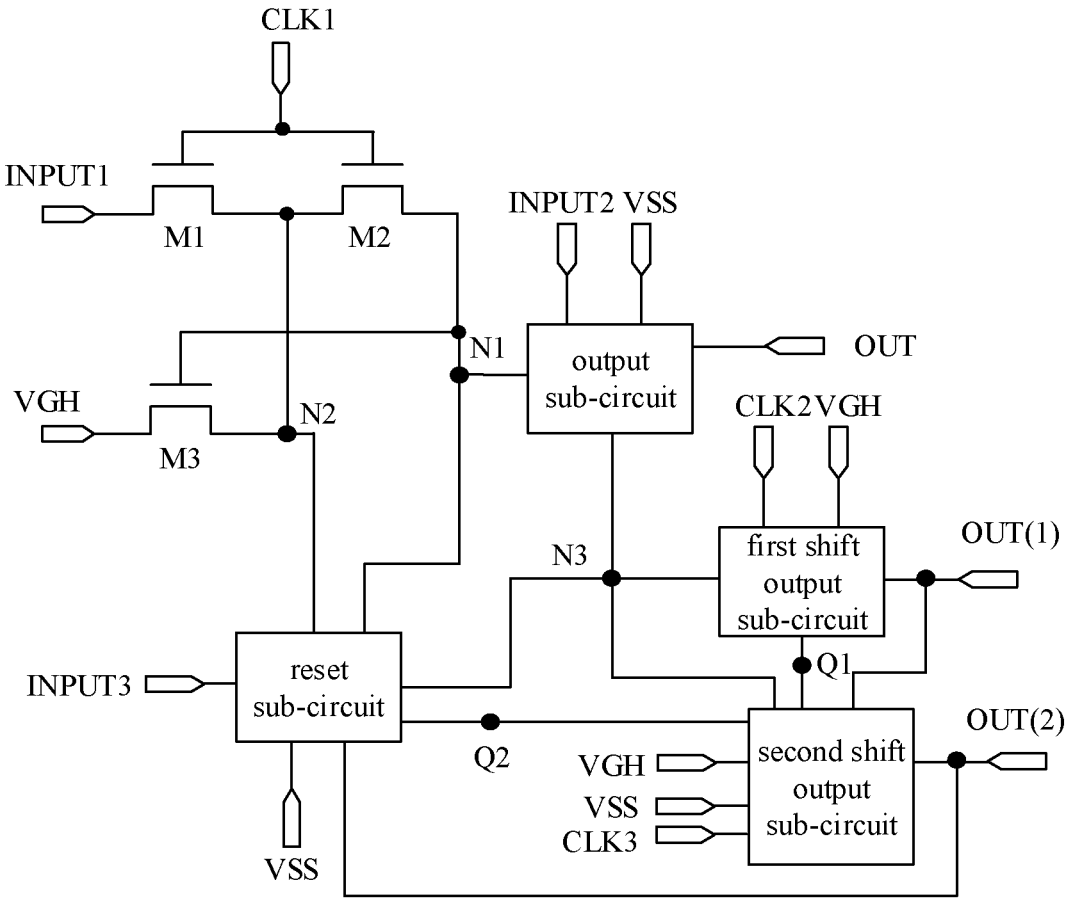
FIG. 4 is an equivalent circuit diagram of an input sub-circuit according to an embodiment of the present disclosure.

Optionally, FIG. 4 is an equivalent circuit diagram of an input sub-circuit according to an embodiment of the present disclosure. As shown in FIG. 4, the input sub-circuit according to the embodiment of the present disclosure includes a first transistor M1, a second transistor M2, and a third transistor M3. It should be noted that m=2 is given as an example in FIG. 4, and the structure of the input sub-circuit according to embodiments of the present disclosure is also applicable to a case where m is equal to another value.

Specifically, a gate electrode of the first transistor M1 is connected with the first clock signal terminal CLK1, a first electrode of the first transistor M1 is connected with the first signal input terminal INPUT1, and a second electrode of the first transistor M1 is connected with the second node N2. A gate electrode of the second transistor M2 is connected with the first clock signal terminal CLK1, a first electrode of the second transistor M2 is connected with the second node N2, and a second electrode of the second transistor M2 is connected with the first node N1. A gate electrode of the third transistor M3 is connected with the first node N1, a first electrode of the third transistor M3 is connected with the first power terminal VGH, and a second electrode of the third transistor M3 is connected with the second node N2.

An exemplary structure of the input sub-circuit is shown in FIG. 4. Those skilled in the art can easily understand that an implementation manner of the input sub-circuit is not limited this, as long as a corresponding function of the input sub-circuit can be realized.

Figure 5:
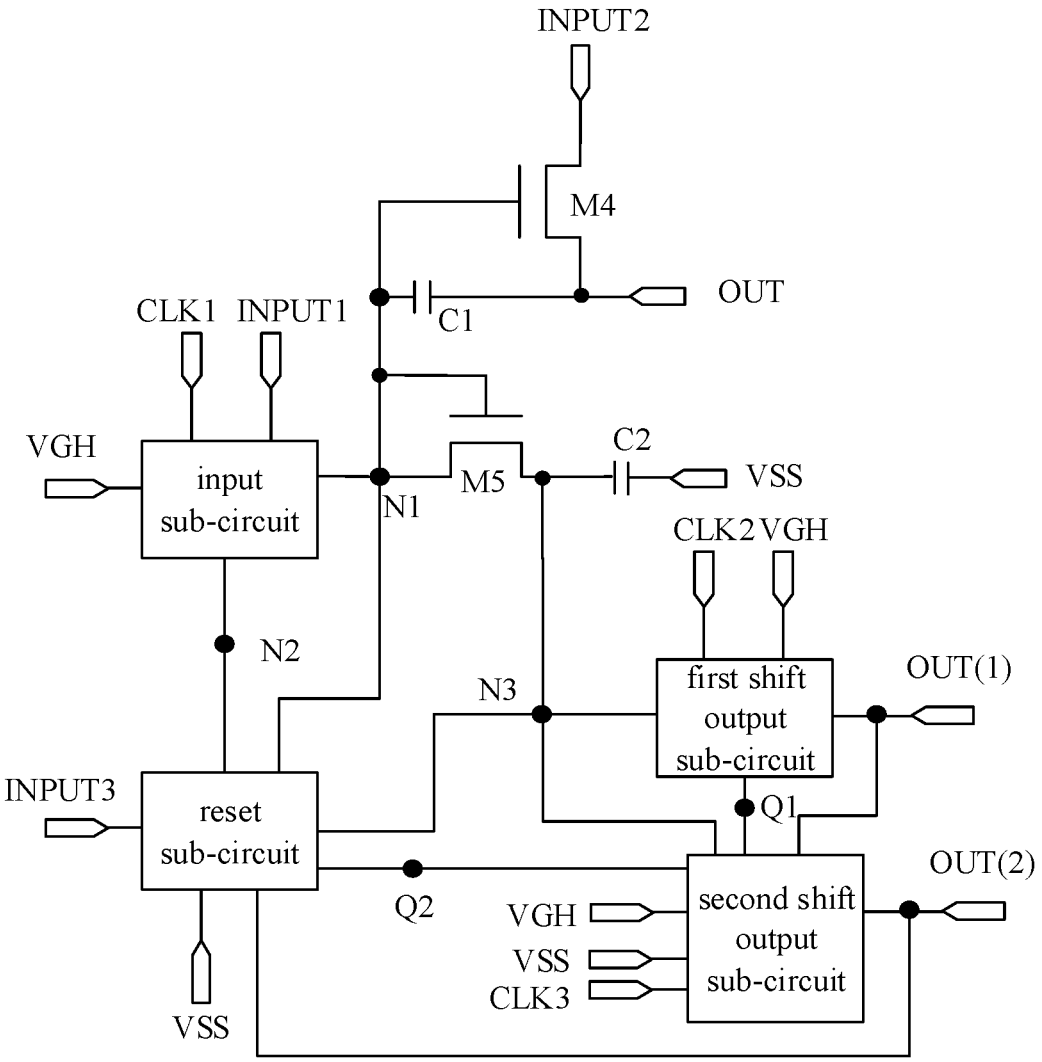
FIG. 5 is an equivalent circuit diagram of an output sub-circuit according to an embodiment of the present disclosure.

Optionally, FIG. 5 is an equivalent circuit diagram of an output sub-circuit according to an embodiment of the present disclosure. As shown in FIG. 5, the output sub-circuit according to an embodiment of the present disclosure includes: a fourth transistor M4, a fifth transistor M5, a first capacitor C1 and a second capacitor C2. It should be noted that m=2 is taken as an example in FIG. 5, and the structure of the output sub-circuit according to embodiments of the present disclosure is also applicable to a case where m is another value.

Specifically, a gate electrode of the fourth transistor M4 is connected with the first node N1, a first electrode of the fourth transistor M4 is connected with the second signal input terminal INPUT2, and a second electrode of the fourth transistor M4 is connected with the first signal output terminal OUT. A gate electrode and a first electrode of the fifth transistor M5 are respectively connected with the first node N1, and a second electrode of the fifth transistor M5 is connected with the third node N3. One end of the first capacitor C1 is connected with the first node N1, and the other end of the first capacitor C1 is connected with the first signal output terminal OUT. One end of the second capacitor C2 is connected with the third node N3, and the other end of the second capacitor C2 is connected with the second power terminal VSS.

An exemplary structure of the output sub-circuit is shown in FIG. 5. Those skilled in the art can easily understand that an implementation manner of the output sub-circuit is not limited to this, as long as the corresponding function of the output sub-circuit can be realized.

Figure 6:
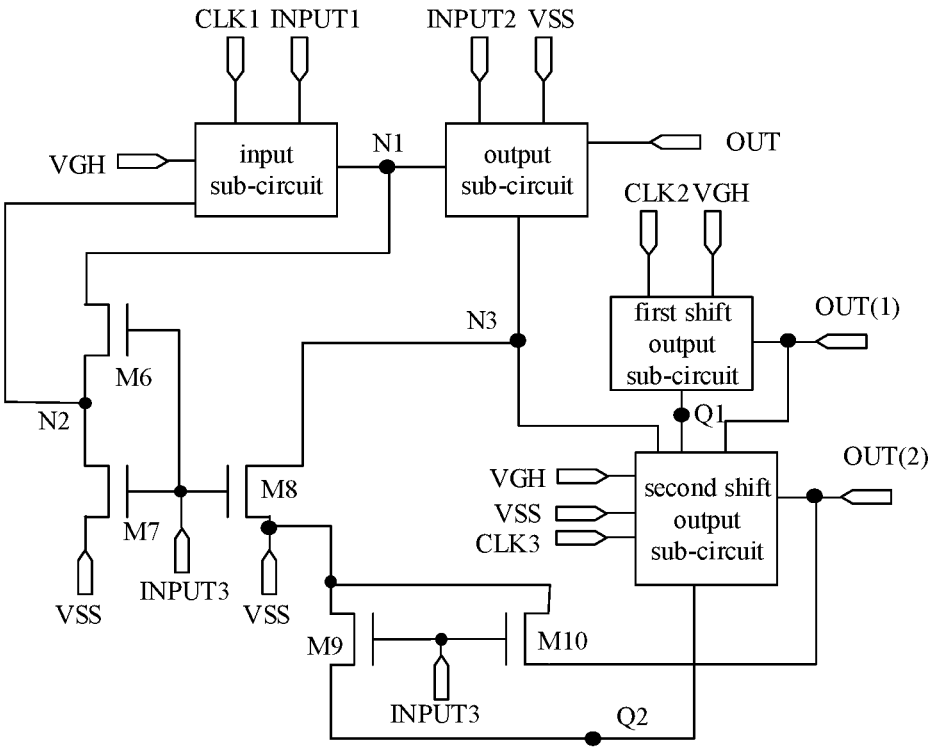
FIG. 6 is an equivalent circuit diagram of a reset sub-circuit according to an embodiment of the present disclosure.

Optionally, FIG. 6 is an equivalent circuit diagram of a reset sub-circuit according to an embodiment of the present disclosure. As shown in FIG. 6, the reset sub-circuit according to an embodiment of the present disclosure includes a sixth transistor M6, a seventh transistor M7, an eighth transistor M8, a ninth transistor M9, and a tenth transistor M10. It should be noted that m=2 is taken as an example in FIG. 6, and the reset sub-circuit has a structure similar to this, when m takes other values, which is not repeated herein.

Specifically, a gate electrode of the sixth transistor M6 is connected with the third signal input terminal INPUT3, a first electrode of the sixth transistor M6 is connected with the first node N1, and a second electrode of the sixth transistor M6 is connected with the second node N2. A gate electrode of the seventh transistor M7 is connected with the third signal input terminal INPUT3, a first electrode of the seventh transistor M7 is connected with the second node N2, and a second electrode of the seventh transistor M7 is connected with the second power terminal VSS. A gate electrode of the eighth transistor M8 is connected with the third signal input terminal INPUT3, a first electrode of the eighth transistor M8 is connected with the third node N3, and a second electrode of the eighth transistor M8 is connected with the second power terminal VSS. A gate electrode of the ninth transistor M9 is connected with the third signal input terminal INPUT3, a first electrode of the ninth transistor M9 is connected with the m-th shift node Qm, and a second electrode of the ninth transistor M9 is connected with the second power terminal VSS. A gate electrode of the tenth transistor M10 is connected with the third signal input terminal INPUT3, a first electrode of the tenth transistor M10 is connected with the m-th shift signal output terminal OUT(m), and a second electrode of the tenth transistor M10 is connected with the second power terminal VSS.

An exemplary structure of the reset sub-circuit is specifically shown in FIG. 6. Those skilled in the art can easily understand that an implementation manner of the reset sub-circuit is not limited this, as long as a corresponding function of the reset sub-circuit can be realized.

Figure 7:
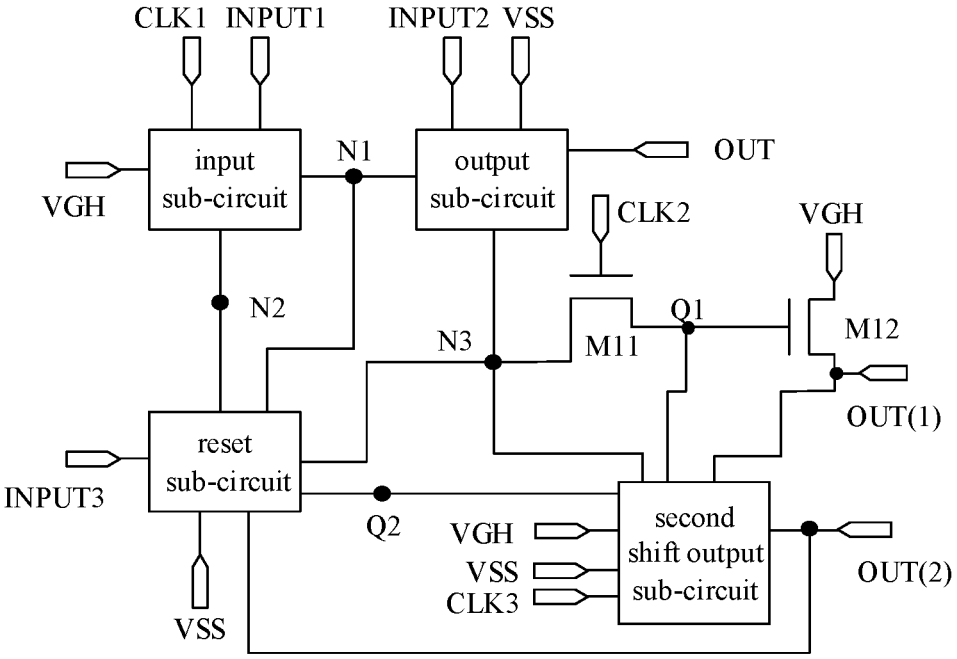
FIG. 7 is an equivalent circuit diagram of a first shift output sub-circuit according to an embodiment of the present disclosure.

Optionally, FIG. 7 is an equivalent circuit diagram of a first shift output sub-circuit according to an embodiment of the present disclosure. As shown in FIG. 7, the first shift output sub-circuit according to an embodiment of the present disclosure includes: an eleventh transistor M11 and a twelfth transistor M12. It should be noted that FIG. 7 takes m=2 as an example, and the structure of the first shift output sub-circuit according to embodiments of the present disclosure is also applicable to a case where m is another value.

Specifically, a gate electrode of the eleventh transistor M11 is connected with the second clock signal terminal CLK2, a first electrode of the eleventh transistor M11 is connected with the third node N3, and a second electrode of the eleventh transistor M11 is connected with the first shift node Q1. A gate electrode of the twelfth transistor M12 is connected with the first shift node Q1, a first electrode of the twelfth transistor M12 is connected with the first power terminal VGH, and a second electrode of the twelfth transistor M12 is connected with the first shift signal output terminal OUT(1).

An exemplary structure of the first shift output sub-circuit is specifically shown in FIG. 7. Those skilled in the art can easily understand that implementation manners of the first shift output sub-circuit is not limited to this, as long as the corresponding function of the first shift output sub-circuit can be realized.

Figure 8:
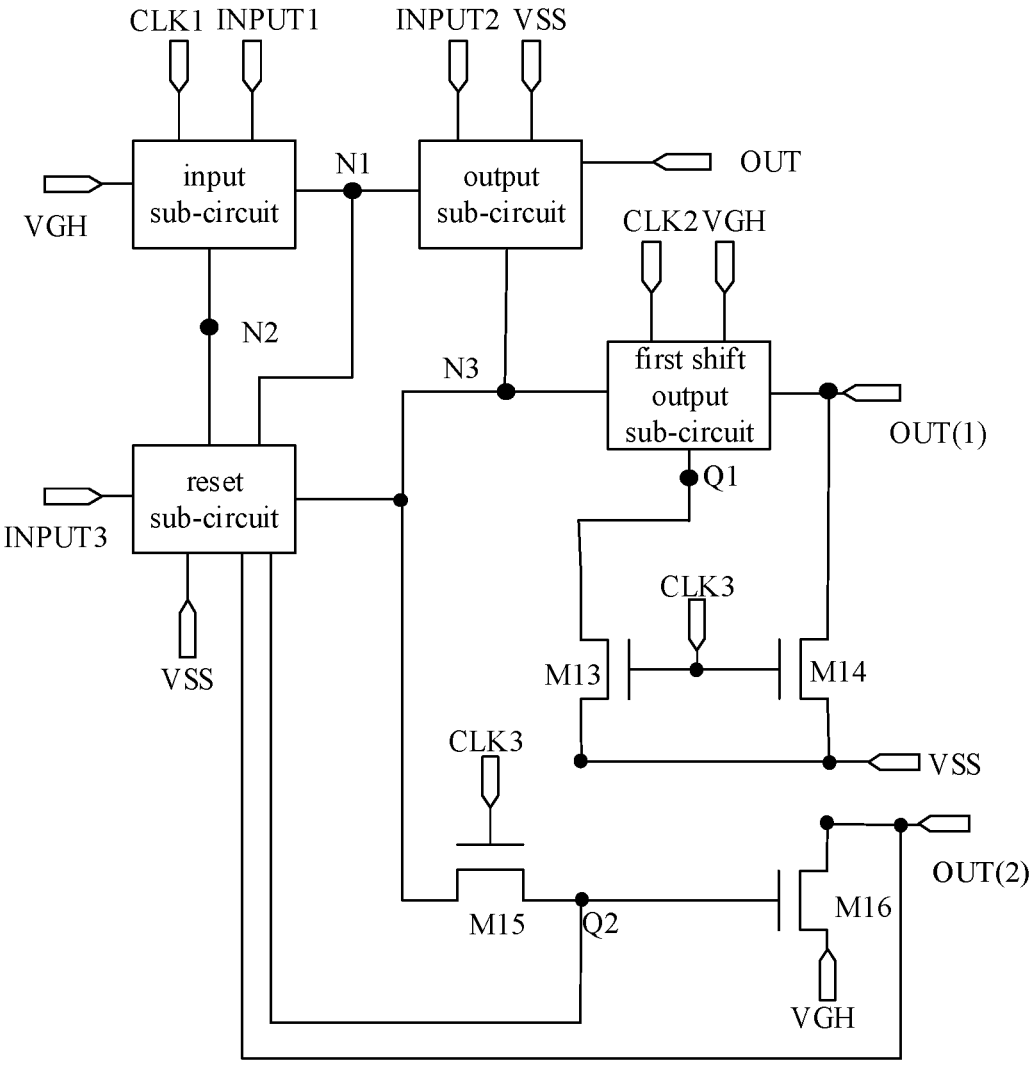
FIG. 8 is an equivalent circuit diagram of a second shift output sub-circuit according to an embodiment of the present disclosure.

Optionally, FIG. 8 is an equivalent circuit diagram of an i-th shift output sub-circuit according to an embodiment of the present disclosure. As shown in FIG. 8, the i-th shift output sub-circuit according to an embodiment of the present disclosure includes a thirteenth transistor M13, a fourteenth transistor M14, a fifteenth transistor M15 and a sixteenth transistor M16. It should be noted that m=2 is given as an example in FIG. 8, and the i-th shift output sub-circuit has a similar structure when m takes other values, which is not repeated herein.

Specifically, a gate electrode of the thirteenth transistor M13 is connected with the (i+1)-th clock signal terminal CLK(i+1), a first electrode of the thirteenth transistor M13 is connected with the (i−1)-th shift node Q(i−1), and a second electrode of the thirteenth transistor M13 is connected with the second power terminal VSS. A gate electrode of the fourteenth transistor M14 is connected with the (i+1)-th clock signal terminal CLK(i+1), a first electrode of the fourteenth transistor M14 is connected with the (i−1)-th shift signal output terminal OUT(i−1), and a second electrode of the fourteenth transistor M14 is connected with the second power terminal VSS. A gate electrode of the fifteenth transistor M15 is connected with the (i+1)-th clock signal terminal CLK(i+1), a first electrode of the fifteenth transistor M15 is connected with the third node N3, and a second electrode of the fifteenth transistor M15 is connected with the i-th shift node Qi. A gate electrode of the sixteenth transistor M16 is connected with the i-th shift node Qi, a first electrode of the sixteenth transistor M16 is connected with the i-th shift signal output terminal OUT(i), and a second electrode of the sixteenth transistor M16 is connected with the first power terminal VGH.

An exemplary structure of the i-th shift output sub-circuit is specifically shown in FIG. 8. Those skilled in the art can easily understand that the implementation manner of the i-th shift output sub-circuit is not limited to this, as long as the corresponding function of the i-th shift output sub-circuit can be realized.

Figure 9:
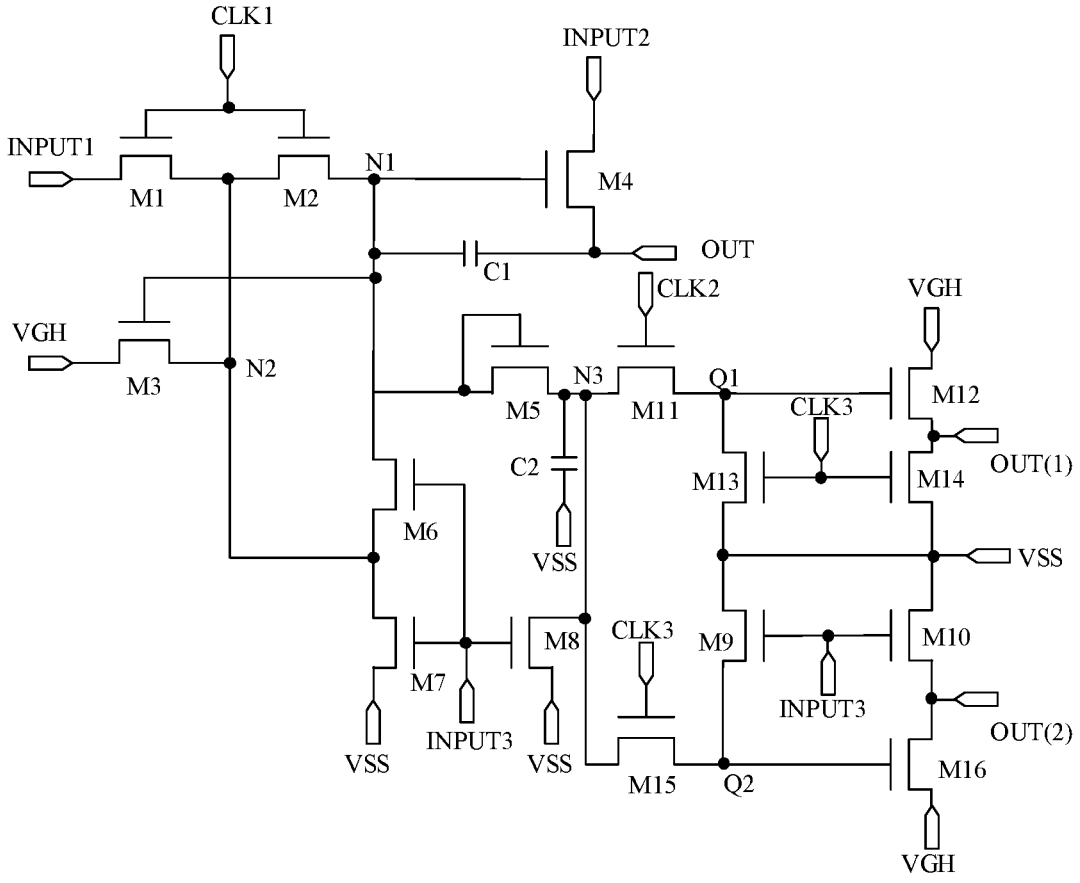
FIG. 9 is a schematic diagram of an exemplary shift register according to an embodiment of the present disclosure.

FIG. 9 is an equivalent circuit diagram of a shift register according to an embodiment of the present disclosure. As shown in FIG. 9, in a shift register according to the embodiment of the present disclosure, the input sub-circuit includes: a first transistor M1, a second transistor M2, and a third transistor M3. The output sub-circuit includes a fourth transistor M4, a fifth transistor M5, a first capacitor C1, and a second capacitor C2. The reset sub-circuit includes a sixth transistor M6, a seventh transistor M7, an eighth transistor M8, and a ninth transistor M9 and a tenth transistor M10. The first shift output sub-circuit includes: an eleventh transistor M11 and a twelfth transistor M12. The i-th shift output sub-circuit includes: a thirteenth transistor M13 and a fourteenth transistor M14, a fifteenth transistor M15 and a sixteenth transistor M16.

Specifically, a gate electrode of the first transistor M1 is connected with the first clock signal terminal CLK1, a first electrode of the first transistor M1 is connected with the first signal input terminal INPUT1, and a second electrode of the first transistor M1 is connected with the second node N2. A gate electrode of the second transistor M2 is connected with the first clock signal terminal CLK1, a first electrode of the second transistor M2 is connected with the second node N2, and a second electrode of the second transistor M2 is connected with the first node N1. A gate electrode of the third transistor M3 is connected with the first node N1, a first electrode of the third transistor M3 is connected with the first power terminal VGH, and a second electrode of the third transistor M3 is connected with the second node N2. A gate electrode of the fourth transistor M4 is connected with the first node N1, a first electrode of the fourth transistor M4 is connected with the second signal input terminal INPUT2, and a second electrode of the fourth transistor M4 is connected with the first signal output terminal OUT. A gate electrode and a first electrode of the fifth transistor M5 are respectively connected with the first node N1, and a second electrode of the fifth transistor M5 is connected with the third node N3. One end of the first capacitor C1 is connected with the first node N1, and the other end of the first capacitor C1 is connected with the first signal output terminal OUT. One end of the second capacitor C2 is connected with the third node N3, and the other end of the second capacitor C2 is connected with the second power terminal VSS. A gate electrode of the sixth transistor M6 is connected with the third signal input terminal INPUT3, a first electrode of the sixth transistor M6 is connected with the first node N1, and a second electrode of the sixth transistor M6 is connected with the second node N2. A gate electrode of the seventh transistor M7 is connected with the third signal input terminal INPUT3, a first electrode of the seventh transistor M7 is connected with the second node N2, and a second electrode of the seventh transistor M7 is connected with the second power terminal VSS. A gate electrode of the eighth transistor M8 is connected with the third signal input terminal INPUT3, a first electrode of the eighth transistor M8 is connected with the third node, and a second electrode of the eighth transistor M8 is connected with the second power terminal. A gate electrode of the ninth transistor M9 is connected with the third signal input terminal INPUT3, a first electrode of the ninth transistor M9 is connected with the m-th shift node Qm, and a second electrode of the ninth transistor M9 is connected with the second power terminal VSS. A gate electrode of the tenth transistor M10 is connected with the third signal input terminal INPUT3, a first electrode of the tenth transistor M10 is connected with the m-th shift signal output terminal OUT(m), and a second electrode of the tenth transistor M10 is connected with the second power supply VSS. A gate electrode of the eleventh transistor M11 is connected with the second clock signal terminal CLK2, a first electrode of the eleventh transistor M11 is connected with the third node N3, and a second electrode of the eleventh transistor M11 is connected with the first shift node Q1. A gate electrode of the twelfth transistor M12 is connected with the first shift node Q1, a first electrode of the twelfth transistor M12 is connected with the first power terminal VGH, and a second electrode of the twelfth transistor M12 is connected with the first shift signal output terminal OUT(1). A gate electrode of the thirteenth transistor M13 is connected with the (i+1)-th clock signal terminal CLK(i+1), and a first electrode of the thirteenth transistor M13 is connected with the (i−1)-th shift node Q(i−1), a second electrode of the thirteenth transistor M13 is connected with the second power terminal VSS. A gate electrode of the fourteenth transistor M14 is connected with the (i+1)-th clock signal terminal CLK(i+1), a first electrode of the fourteenth transistor M14 is connected with the (i−1)-th shift signal output terminal OUT(i−1), and a second electrode of the fourteenth transistor M14 is connected with the second power terminal VSS. A gate electrode of the fifteenth transistor M15 is connected with the (i+1)-th clock signal terminal CLK(i+1), a first electrode of the fifteenth transistor M15 is connected with the third node N3, and a second electrode of the fifteenth transistor M15 is connected with the i-th shift node Qi. A gate electrode of the sixteenth transistor M16 is connected with the i-th shift node Qi, a first electrode of the sixteenth transistor M16 is connected with the i-th shift signal output terminal OUT(i), and a second electrode of the sixteenth transistor M16 is the first power terminal VGH.

Exemplary structures of an input sub-circuit, an output sub-circuit, a reset sub-circuit, a first shift-output sub-circuit, and a second shift-output sub-circuit are specifically shown in FIG. 9. Those skilled in the art can easily understand that the implementation manners of the above sub-circuits are not limited these, as long as their respective functions can be achieved.

Optionally, a frequency of a pulse signal inputted into the second signal input terminal INPUT2 is f and a frequency of each signal inputted into the first clock signal terminal CLK1 to the (i+1)-th clock signal terminal CLK(i+1) is m*f, which ensures that a potential of the first node N1 is always high when the first shift signal output terminal OUT(1) to the m-th shift signal output terminal OUT(m) output a high level.

In view of the above, in the embodiments of the present disclosure, a first stage of output shift function of the gate driving circuit is implemented through the second clock signal terminal CLK2 and the eleventh transistor M11, and a second stage of output shift function of the gate driving circuit is implemented through the third clock signal terminal CLK3 and the fifteenth transistor M15, where channel sizes of the eleventh transistor M11 and the fifteenth transistor M15 are relatively small (for example, the width-to-length ratio W/L may be 20/8). Therefore, a quite low power is consumed during circuit operation. In the embodiments of the present disclosure, the drain electrodes of the twelfth transistor M12 and the sixteenth transistor M16 as pull-up transistors are connected with a direct current (DC) high-voltage signal of the first power terminal VGH. The power consumption of the gate drive circuit is mainly generated by the pull-up transistors, and based on an equivalent formula, the power consumption of the gate driving circuit is calculated as: $P \approx 2\times(C1+C2)\times V*V\times F=2\times(C1+C2)\times V*V\times 0=0$, where a frequency of the DC high-voltage signal of the first power terminal VGH is 0. Therefore, circuit power consumption of the shift register according to the embodiments of the present disclosure is greatly reduced.

Two or multiple stages of shift outputs are achieved in the embodiments of the present disclosure through one stage of gate driving circuit, thereby decreasing the size of a frame of a display panel.

In the embodiments of the present disclosure, the second node N2 is connected between the first transistor M1 and the second transistor M2, and is also connected between the sixth transistor M6 and the seventh transistor M7, thereby reducing a leakage current of the first node N1. The second capacitor C2 stores the voltage of the second node N2 and is used for filtering, thereby avoiding glitches on the signal at the output terminal.

In an optional embodiment, all the transistors M1 to M16 may be N-type thin film transistors or P-type thin film transistors, which can unify the process flow, reduce the number of process flows, and improve the yield of the product. In addition, considering that the low-temperature polysilicon thin film transistor has a small leakage current, all the transistors in the embodiments of the present disclosure may be low-temperature polysilicon thin film transistors. The thin film transistor may specifically be a bottom-gate thin film transistor or a top-gate thin film transistor, as long as the switching function can be realized. In the embodiments of the present disclosure, in order to distinguish two electrodes of a transistor except the gate electrode, one is referred to as a first electrode, and the other one is referred to as a second electrode. When a transistor is an N-type transistor, a voltage for turning on the transistor (referred to as a turn-on voltage) is a high level voltage (for example, 5V, 10V, or other suitable voltage), and a voltage for turning off the transistor (referred to as a turn-off voltage) is a low level voltage (for example, 0V, −5V, −10V, or other suitable voltage).

It should be noted that the first capacitor C1 and the second capacitor C2 may be a liquid crystal capacitor formed by a pixel electrode and a common electrode, or a liquid crystal capacitor included by a pixel electrode and a common electrode, and an equivalent capacitor formed by a storage capacitor, which is not limited herein.

The technical solution of the embodiments of the present disclosure is further described below through a working process of a shift register. It should be noted that a working process of a first stage of shift register is given as an example in the following description.

Figure 10:
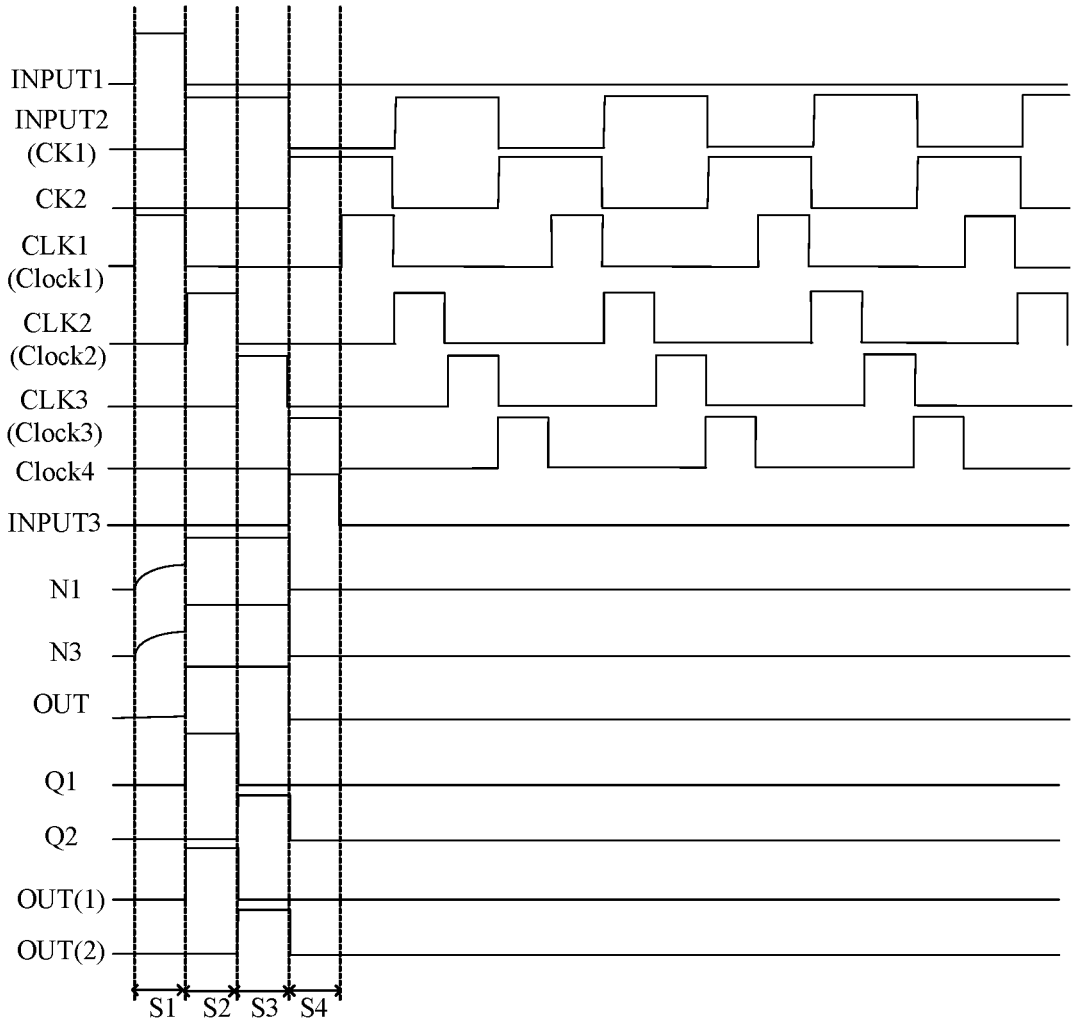
FIG. 10 is a timing diagram of a shift register according to an embodiment of the present disclosure.

An example that the transistors M1 to M16 in the shift register according to the embodiments of the present disclosure are N-type thin film transistors is given. FIG. 10 is a timing diagram of a shift register according to an embodiment of the present disclosure. As shown in FIG. 9 and FIG. 10, the shift register according to the embodiment of the present disclosure includes sixteen transistor units (M1 to M16), two capacitor units (C1, C2), six input terminals (INPUT1, INPUT2, INPUT3, CLK1, CLK2, and CLK3), M+1 output terminals (OUT, OUT(N) to OUT (N+m−1)) and two power terminals (VSS and VGH). The first power terminal VGH continuously supplies a high-level signal, and the second power terminal VSS continuously supplies a low-level signal. The working process of a shift register is as follows.

In a first stage S1, also referred to as the input stage, an input signal of the first signal input terminal INPUT1 is at a high level, an input signal of the first clock signal terminal CLK1 is at a high level, the first transistor M1 and the second transistor M2 are turned on, a potential of the first node N1 is pulled up by the high level of INPUT1, and the first capacitor C1 is charged by the first node N1. Since the potential of the first node N1 is pulled up, the third transistor M3, the fourth transistor M4, and the fifth transistor M5 are turned on. At this time, an input signal of the second signal input terminal INPUT2 is at a low level, the low-level signal of the second signal input terminal INPUT2 is written into the first signal output terminal OUT through the turned-on fourth transistor M4, and the voltage of the first node N1 is transmitted to the third node N3 through the fifth transistor M5 that is turned on. The high-level signal of the first power terminal VGH is written into the second node N2, and the role of the third transistor M3 is to maintain the voltage of the first node N1 to be stable.

In a second stage S2, also referred to as the first output stage, the input signal of the first signal input terminal INPUT1 is at a low level, and the input signal of the second signal input terminal INPUT2 is at a high level. Under the bootstrapping effect of the capacitor C1, the potential of the first node N1 is raised to a second high level. The voltage of the first node N1 is transmitted to the third node N3 through the fifth transistor M5 that is turned on. The input signal of the second signal input terminal INPUT2 is outputted to the signal output terminal OUT through the fourth transistor M4 that is turned on.

The input signal of the second clock signal terminal CLK2 is at a high level, the eleventh transistor M11 is turned on, and the voltage of the third node N3 is transmitted to the first shift node Q1. At this time, the twelfth transistor M12 is turned on, a high level is outputted at the first shift signal output terminal OUT(1), and a first stage of shift output function is realized through the second clock signal terminal CLK2 and the eleventh transistor M11.

In a third stage S3, also referred to as the second output stage, an input signal of the third clock signal terminal CLK3 is at a high level, the fifteenth transistor M15 is turned on, and the voltage of the third node N3 is transferred to the second shift node Q2. At the time, the sixteenth transistor M16 is turned on, and a high level is outputted by the second shift signal output terminal OUT(2). The second stage of shift output function is realized through the third clock signal terminal CLK3 and the fifteenth transistor M15. The thirteen transistors M13 and the fourteenth transistor M14 are turned on, and voltages of the first shift node Q1 and the first shift signal output terminal OUT(1) are pulled down.

When m>2, working processes of the third shift output sub-circuit to the m-th shift output sub-circuit are similar to the working process of the second shift output sub-circuit, which is not repeated herein.

In a fourth stage S4, also referred to as the reset stage, the input signal of the third signal input terminal INPUT3 is at a high level, the sixth transistor M6, the seventh transistor M7, the eighth transistor M8, the ninth transistor M9 and the tenth transistor M10 are turned on. The voltage of the first node N1 is pulled down by a low level of the second power terminal VSS due to the sixth transistor M6 and the seventh transistor M7 that are turned on, the voltage of the third node N3 is pulled down by the low level of the second power terminal VSS due to the eighth transistor M8 that is turned on. The voltage of the m-th shift node Qm is pulled down by the low level of the second power terminal VSS due to the ninth transistor M9 in a turned-on state. The voltage of the m-th shift signal output terminal OUT(m) is pulled down by the low level of the second power terminal VSS due to the tenth transistor M10 in a turned-on state.

Figure 11:
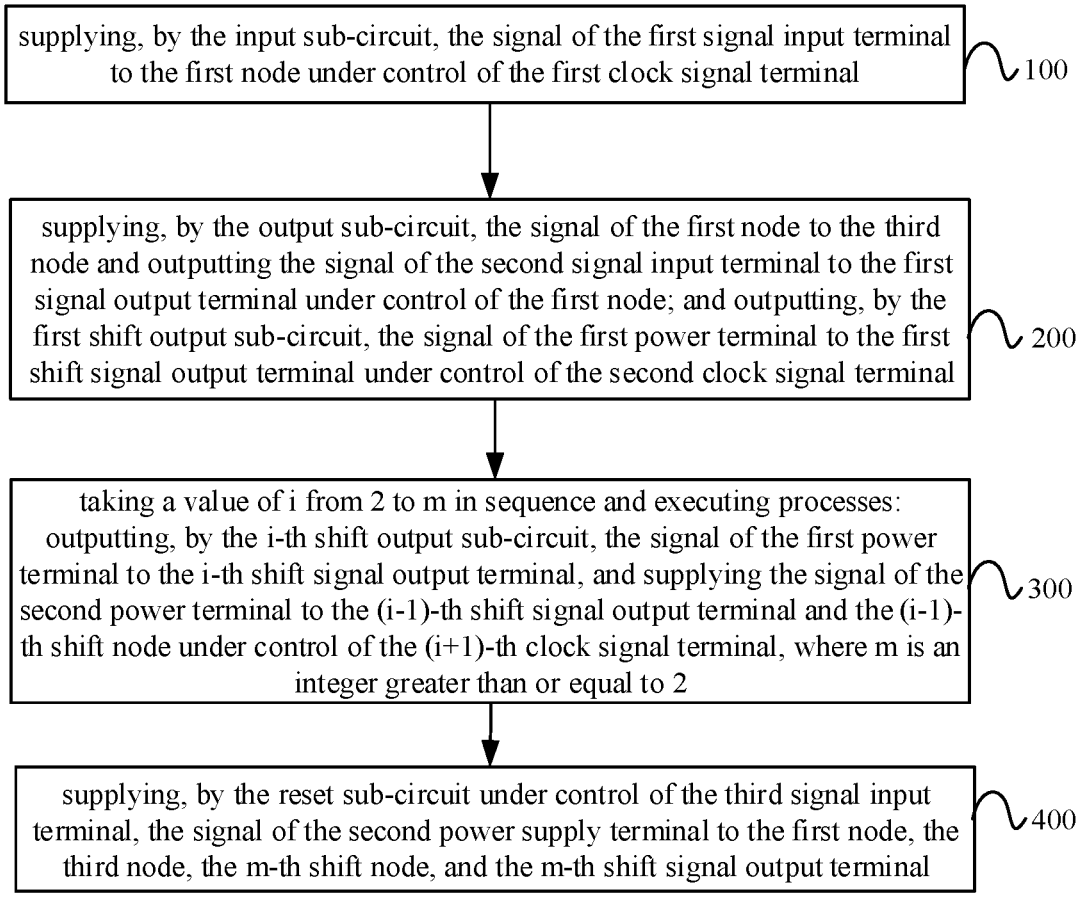
FIG. 11 is a flowchart of a method for driving a shift register according to an embodiment of the present disclosure.

Based on the same inventive concept, some embodiments of the present disclosure further provide a method for driving a shift register, which is applied to the shift register provided in the foregoing embodiments. The shift register includes: the input sub-circuit, the output sub-circuit, the reset sub-circuit, the first shift output sub-circuit to the m-th shift output sub-circuit, m being an integer greater than or equal to 2, the first signal input terminal, the second signal input terminal, the third signal input terminal, the first clock signal terminal, the second clock signal terminal, the third clock signal terminal, the first power terminal, the second power terminal, the first signal output terminal, and the first shift signal output terminal to the i-th shift signal output terminal. The first power terminal keeps supplying a high-level signal, and the second power terminal continuously supplies a low-level signal. FIG. 11 is a flowchart of a method for driving a shift register according to an embodiment of the present disclosure. As shown in FIG. 11, the method specifically includes the following steps 100 to 400.

Step 100 includes: supplying, by the input sub-circuit, the signal of the first signal input terminal to the first node under control of the first clock signal terminal.

Specifically, the signal inputted into the first clock signal terminal is a pulse signal. In step 100, the signal inputted into the first signal input terminal is at a high level, and the input sub-circuit raises the potential of the first node.

Step 200 includes: supplying, by the output sub-circuit, the signal of the first node to the third node and outputting the signal of the second signal input terminal to the first signal output terminal under control of the first node; and outputting, by the first shift output sub-circuit, the signal of the first power terminal to the first shift signal output terminal under control of the second clock signal terminal.

Specifically, the signal inputted into the second signal input terminal is a pulse signal, and the signal inputted into the second clock signal terminal is a pulse signal. In this step, the signal inputted into the second signal input terminal is at a high level, and the signal inputted into the second clock signal terminal is at a high level, the output sub-circuit pulls up the potential of the third node, thus signals outputted by the first signal output terminal and the first shift signal output terminal are both at a high level.

Step 300 includes: taking a value of i from 2 to m in sequence and executing processes: outputting, by the i-th shift output sub-circuit, the signal of the first power terminal to the i-th shift signal output terminal, and supplying the signal of the second power terminal to the (i−1)-th shift signal output terminal and the (i−1)-th shift node under control of the (i+1)-th clock signal terminal, where m is an integer greater than or equal to 2.

Specifically, for each i during execution, the input signal at the (i+1)-th clock signal terminal is a pulse signal. In this step, the input signal at the (i+1)-th clock signal terminal is at a high level, the i-th shift output sub-circuit pulls down a level of the (i−1)-th shift signal output terminal and a level of the (i−1)-th shift node to the low-level signal of the second power terminal, and the signal outputted by the i-th shift signal output terminal is at a high level.

Step 400 includes: supplying, by the reset sub-circuit under control of the third signal input terminal, the signal of the second power terminal to the first node, the third node, the m-th shift node, and the m-th shift signal output terminal.

In some embodiments, the method further includes:

in an input period, inputting a first-level signal to the first signal input terminal and the first clock signal terminal so that a potential of the first node and a potential of the second node are pulled to a first level by the input sub-circuit;

in a first output period, inputting a first-level signal to the second signal input terminal and the second clock signal terminal, so that the first level is outputted to the first signal output terminal by the output sub-circuit in response to the potential of the first node, and a first level of the first power terminal is outputted to the first shift signal output terminal by the output sub-circuit in response to a potential of the third node;

in a second output period, taking a value of i from 2 to m sequentially and executing processes: inputting a first-level signal to the second signal input terminal and the (i+1)-th clock signal terminal, so that the i-th output sub-circuit outputs a first level of the first power terminal to the i-th shift signal output terminal, and transmits a second level of the second power terminal to the (i−1)-th shift node; and in a reset period, inputting a first-level signal to the third signal input terminal, so that potentials of the first node, the third node, the m-th shift node and the m-th shift signal output terminal are pulled to the second level of the second power terminal by the reset sub-circuit.

Specifically, the signal outputted by the third signal input terminal is at a high level, and the reset sub-circuit pulls down the potentials of the first node, the third node, the m-th shift node, and the m-th shift signal output terminal.

The method for driving the shift register provided by the embodiments of the present disclosure realizes two or more stages of outputs through the first shift output sub-circuit to the m-th shift output sub-circuit, which reduces the frame size of a display panel and circuit power consumption of the display panel, thereby improving display quality of the display panel.

Figure 12:
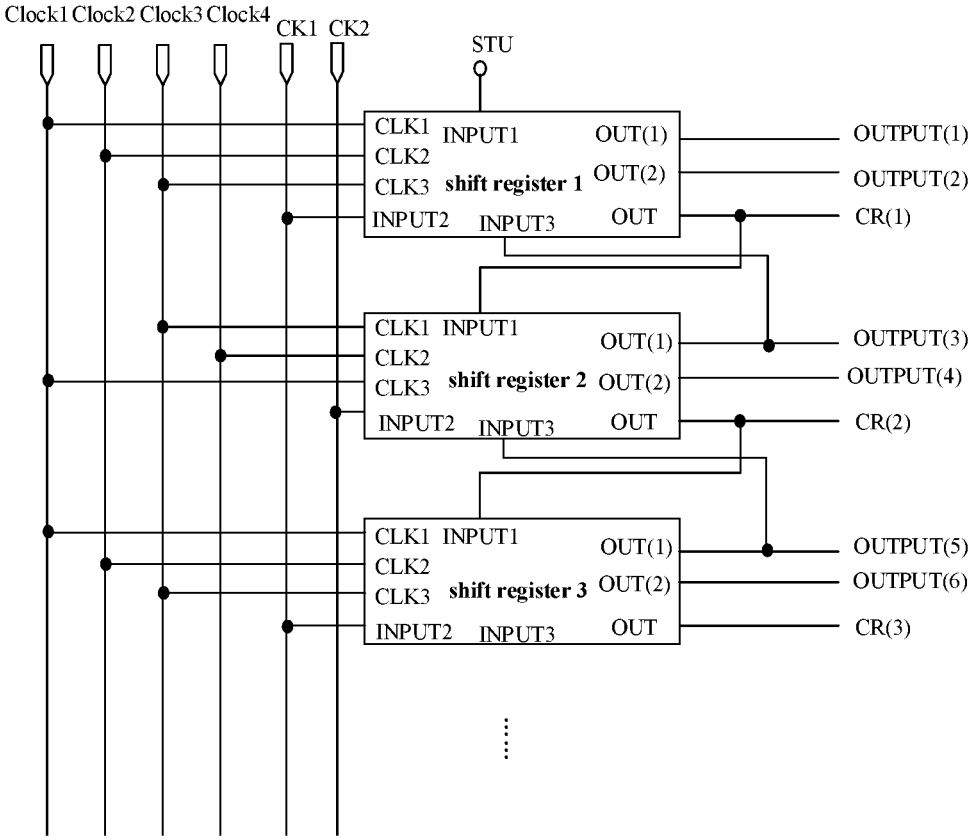
FIG. 12 is a schematic diagram of a gate driving circuit according to an embodiment of the present disclosure.

Based on the same inventive concept, a gate driving circuit is provided according to an embodiment of the present disclosure. FIG. 12 is a schematic diagram of a gate driving circuit according to an embodiment of the present disclosure. As shown in FIG. 12, the gate driving circuit includes: a plurality of stages of shift registers that are cascaded, which includes: a first stage shift register GOA(1), a second stage shift register GOA(2), an m-th stage shift register GOA(m), and the like. It should be noted that FIG. 12 takes m=2 as an example, and when m is equal to another value, the gate driving circuit has a similar structure, which is not repeated herein.

Specifically, a first signal input terminal of the first stage shift register is connected with an initial signal input terminal, and a first signal input terminal of an (N+1)-th stage shift register is connected with a first signal output terminal of an N-th stage shift register, N being an integer greater than or equal to 1.

A first signal input terminal of a first stage of the shift registers is connected with an initial signal input terminal, and a first signal input terminal of an (N+1)-th stage of the shift registers is connected with a first signal output terminal of an N-th stage of the shift registers, N being an integer greater than or equal to 1.

A second signal input terminal of an odd-numbered stage of the shift registers is connected with an external first input terminal, and a second signal input terminal of an even-numbered stage of the shift registers is connected with an external second input terminal.

A third signal input terminal of the N-th stage shift register is connected with a first shift signal output terminal of the (N+1)-th stage shift register.

A first clock signal terminal of the odd-numbered stage shift register is connected with an external first clock signal line, a second clock signal terminal of the odd-numbered stage shift register is connected with an external second clock signal line, and a third clock signal terminal of the odd-numbered stage shift register is connected with an external third clock signal line.

A first clock signal terminal of the even-numbered stage shift register is connected with the external third clock signal line, a second clock signal terminal of the even-numbered stage shift register is connected with an external fourth clock signal line, and a third clock signal terminal of the even-numbered stage shift register is connected with the external first clock signal line.

Signals inputted into the first input terminal and the second input terminal are pulse signals with opposite phases, frequencies of the signals inputted into the first input terminal and the second input terminal are both f and a frequency of each clock signal inputted into the first clock signal line, the second clock signal line, the third clock signal line and the fourth clock signal line is m*f where m is the number of output stages of the shift output sub-circuit included in each stage of the shift registers.

As shown in FIG. 12, the first signal input terminal INPUT1 of the first stage shift register GOA(1) is connected with the initial signal input terminal STU, the first clock signal terminal CLK1 is connected with an external first clock signal line Clock1, the second clock signal terminal CLK2 is connected with an external second clock signal line Clock2, the third clock signal terminal CLK3 is connected with an external third clock signal line Clock3, the second signal input terminal INPUT2 is connected with an external first input terminal CK1, and the signal output terminal OUT is connected with the first signal input terminal INPUT1 of the second stage shift register GOA(2). The first clock signal terminal CLK1 of the second stage shift register GOA(2) is connected with an external third clock signal line Clock3, the second clock signal terminal CLK2 is connected with an external fourth clock signal line Clock4, the third clock signal terminal CLK3 is connected with an external first clock signal line Clock1, the second signal input terminal INPUT2 is connected with an external second input terminal CK2, and the first signal output terminal OUT is connected with the first signal input terminal INPUT1 of the third stage shift register GOA(3); and so on.

Signals inputted to the external first input terminal CK1 and the second input terminal CK2 are low-frequency AC signals that alternately work (generally pulse signals with opposite phases). A frequency of each clock signal inputted to the first clock signal line Clock1, the second clock signal line Clock2, the third clock signal line Clock3, and the fourth clock signal line Clock4 is m times of a frequency of each signal inputted to the first input terminal CK1 and the second input terminal CK2, thereby ensuring the potential of the first node to be always high when a high level is continuously outputted by the first shift signal output terminal to the m-th shift signal output terminal.

The shift register is a shift register provided in the above embodiments, and implementation principles and implementation effects in this embodiment are similar to these in the above embodiments, and details are not described herein again.

Figure 13:
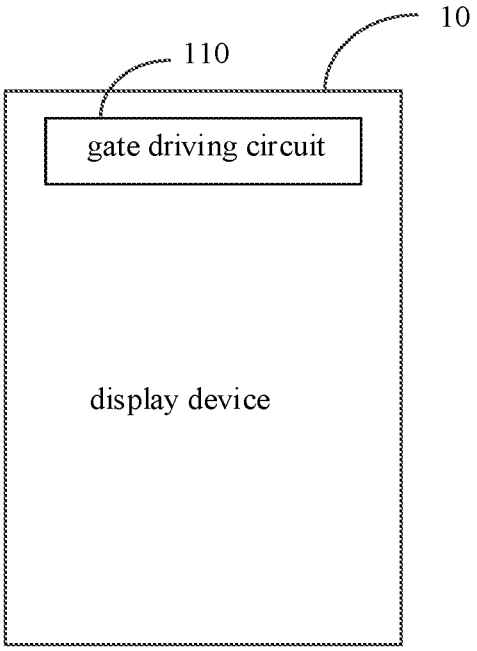
FIG. 13 is a schematic block diagram of a display device according to an embodiment of the present disclosure.

FIG. 13 is a schematic block diagram of a display device according to an embodiment of the present disclosure. As shown in FIG. 13, the display device 10 may include the gate driving circuit 110 according to the above embodiments of the present disclosure. The display device according to an embodiment of the present disclosure may be any product or component having a display function, such as an electronic paper, a mobile phone, a tablet computer, a television, a display, a notebook computer, a digital photo frame, a navigator, and the like.

The shift register in the embodiments of the present disclosure realizes two or more stages of outputs through the first shift output sub-circuit to the m-th shift output sub-circuit, which reduces the size of a frame of a display panel and power consumption of the shift register, thereby improving display quality of the display panel.

It should be noted that drawings of the embodiments of the present disclosure only relate to structures involved in the embodiments of the present disclosure, and other structures can refer to the general design.

In case of no conflict, the embodiments of the present disclosure, that is, features in the embodiments, can be combined with each other to obtain new embodiments.

Although the embodiments disclosed in the present disclosure are as described above, the described content is only implementations for facilitating understanding of the present disclosure, and is not intended to limit the present disclosure. Any person skilled in the art can make any modifications and changes in the form and details of implementation without departing from the spirit and scope disclosed in present disclosure. The protection scope of the present disclosure shall be subject to the scope defined by the appended claims.

What is claimed is:

1. A shift register, comprising: an input sub-circuit, an output sub-circuit, a reset sub-circuit, and a first shift output sub-circuit to an m-th shift output sub-circuit, m being an integer greater than or equal to 2, wherein:

the input sub-circuit is connected with a first signal input terminal, a first clock signal terminal, a first node, a second node and a first power terminal, and is configured to supply a signal of the first signal input terminal to the first node under control of the first clock signal terminal;

the output sub-circuit is connected with a second signal input terminal, a first signal output terminal, the first node, a third node and a second power terminal, and is configured to output a signal of the first node to the third node and a signal of the second signal input terminal to the first signal output terminal under control of the first node;

the reset sub-circuit is connected with the first node, the second node, the third node, an m-th shift node, the second power terminal, an m-th shift signal output terminal and a third signal input terminal, and is configured to supply a signal of the second power terminal to the first node, the third node, the m-th shift node, and the m-th shift signal output terminal under control of the third signal input terminal;

the first shift output sub-circuit is connected with the third node, a first shift node, a second clock signal terminal, the first power terminal and a first shift signal output terminal, and is configured to output a signal of the first power terminal to the first shift signal output terminal under control of the second clock signal terminal and in response to a signal of the third node; and an i-th shift output sub-circuit is connected with the third node, an (i−1)-th shift node, an i-th shift node, an (i+1)-th clock signal terminal, the first power terminal, the second power terminal, an (i−1)-th shift signal output terminal and an i-th shift signal output terminal, and is configured to output the signal of the first power terminal to the i-th shift signal output terminal under control of the (i+1)-th clock signal terminal and in response to the signal of the third node, and supply the signal of the second power terminal to the (i−1)-th shift signal output terminal and the (i−1)-th shift node under control of the (i+1)-th clock signal terminal, where i is an integer that is greater than or equal to 2 and less than or equal to m.

2. The shift register according to claim 1, wherein the input sub-circuit comprises:

a first transistor, a second transistor, and a third transistor, wherein:

a gate electrode of the first transistor is connected with the first clock signal terminal, a first electrode of the first transistor is connected with the first signal input terminal, and a second electrode of the first transistor is connected with the second node;

a gate electrode of the second transistor is connected with the first clock signal terminal, a first electrode of the second transistor is connected with the second node, and a second electrode of the second transistor is connected with the first node; and a gate electrode of the third transistor is connected with the first node, a first electrode of the third transistor is connected with the first power terminal, and a second electrode of the third transistor is connected with the second node.

3. The shift register according to claim 1, wherein the output sub-circuit comprises:

a fourth transistor, a fifth transistor, a first capacitor, and a second capacitor, wherein:

a gate electrode of the fourth transistor is connected with the first node, a first electrode of the fourth transistor is connected with the second signal input terminal, and a second electrode of the fourth transistor is connected with the first signal output terminal;

a gate electrode and a first electrode of the fifth transistor are connected with the first node, and a second electrode of the fifth transistor is connected with the third node;

one end of the first capacitor is connected with the first node, and the other end of the first capacitor is connected with the first signal output terminal; and one end of the second capacitor is connected with the third node, and the other end of the second capacitor is connected with the second power terminal.

4. The shift register according to claim 1, wherein the reset sub-circuit comprises:

a sixth transistor, a seventh transistor, an eighth transistor, a ninth transistor, and a tenth transistor, wherein:

a gate electrode of the sixth transistor is connected with the third signal input terminal, a first electrode of the sixth transistor is connected with the first node, and a second electrode of the sixth transistor is connected with the second node;

a gate electrode of the seventh transistor is connected with the third signal input terminal, a first electrode of the seventh transistor is connected with the second node, and a second electrode of the seventh transistor is connected with the second power terminal;

a gate electrode of the eighth transistor is connected with the third signal input terminal, a first electrode of the eighth transistor is connected with the third node, and a second electrode of the eighth transistor is connected with the second power terminal;

a gate electrode of the ninth transistor is connected with the third signal input terminal, a first electrode of the ninth transistor is connected with the m-th shift node, and a second electrode of the ninth transistor is connected with the second power terminal; and a gate electrode of the tenth transistor is connected with the third signal input terminal, a first electrode of the tenth transistor is connected with the m-th shift signal output terminal, and a second electrode of the tenth transistor is connected with the second power terminal.

5. The shift register according to claim 1, wherein the first shift output sub-circuit comprises: an eleventh transistor and a twelfth transistor, wherein:

a gate electrode of the eleventh transistor is connected with the second clock signal terminal, a first electrode of the eleventh transistor is connected with the third node, and a second electrode of the eleventh transistor is connected with the first shift node; and a gate electrode of the twelfth transistor is connected with the first shift node, a first electrode of the twelfth transistor is connected with the first power terminal, and a second electrode of the twelfth transistor is connected with the first shift signal output terminal.

6. The shift register according to claim 1, wherein the i-th shift output sub-circuit comprises: a thirteenth transistor, a fourteenth transistor, a fifteenth transistor, and a sixteenth transistor, wherein:

a gate electrode of the thirteenth transistor is connected with the (i+1)-th clock signal terminal, a first electrode of the thirteenth transistor is connected with the (i−1)-th shift node, and a second electrode of the thirteenth transistor is connected with the second power terminal;

a gate electrode of the fourteenth transistor is connected with the (i+1)-th clock signal terminal, a first electrode of the fourteenth transistor is connected with the (i−1)-th shift signal output terminal, and a second electrode of the fourteenth transistor is connected with the second power terminal;

a gate electrode of the fifteenth transistor is connected with the (i+1)-th clock signal terminal, a first electrode of the fifteenth transistor is connected with the third node, and a second electrode of the fifteenth transistor is connected with the i-th shift node; and a gate electrode of the sixteenth transistor is connected with the i-th shift node, a first electrode of the sixteenth transistor is connected with the i-th shift signal output terminal, and a second electrode of the sixteenth transistor is connected with the first power terminal.

7. The shift register according to claim 1, wherein the input sub-circuit comprises a first transistor, a second transistor and a third transistor, the output sub-circuit comprises a fourth transistor, a fifth transistor, a first capacitor and a second capacitor, the reset sub-circuit comprises a sixth transistor, a seventh transistor, an eighth transistor, a ninth transistor and a tenth transistor, the first shift output sub-circuit comprises an eleventh transistor and a twelfth transistor, and the i-th shift output sub-circuit comprises a thirteenth transistor, a fourteenth transistor, a fifteenth transistor and a sixteenth transistor, wherein:

a gate electrode of the first transistor is connected with the first clock signal terminal, a first electrode of the first transistor is connected with the first signal input terminal, and a second electrode of the first transistor is connected with the second node;

a gate electrode of the second transistor is connected with the first clock signal terminal, a first electrode of the second transistor is connected with the second node, and a second electrode of the second transistor is connected with the first node;

a gate electrode of the third transistor is connected with the first node, a first electrode of the third transistor is connected with the first power terminal, and a second electrode of the third transistor is connected with the second node;

a gate electrode of the fourth transistor is connected with the first node, a first electrode of the fourth transistor is connected with the second signal input terminal, and a second electrode of the fourth transistor is connected with the first signal output terminal;

a gate electrode and a first electrode of the fifth transistor are connected with the first node, and a second electrode of the fifth transistor is connected with the third node;

one end of the first capacitor is connected with the first node, and the other end of the first capacitor is connected with the first signal output terminal;

one end of the second capacitor is connected with the third node, and the other end of the second capacitor is connected with the second power terminal;

a gate electrode of the sixth transistor is connected with the third signal input terminal, a first electrode of the sixth transistor is connected with the first node, and a second electrode of the sixth transistor is connected with the second node;

a gate electrode of the seventh transistor is connected with the third signal input terminal, a first electrode of the seventh transistor is connected with the second node, and a second electrode of the seventh transistor is connected with the second power terminal;

a gate electrode of the eighth transistor is connected with the third signal input terminal, a first electrode of the eighth transistor is connected with the third node, and a second electrode of the eighth transistor is connected with the second power terminal;

a gate electrode of the ninth transistor is connected with the third signal input terminal, a first electrode of the ninth transistor is connected with the m-th shift node, and a second electrode of the ninth transistor is connected with the second power terminal;

a gate electrode of the tenth transistor is connected with the third signal input terminal, a first electrode of the tenth transistor is connected with the m-th shift signal output terminal, and a second electrode of the tenth transistor is connected with the second power terminal;

a gate electrode of the eleventh transistor is connected with the second clock signal terminal, a first electrode of the eleventh transistor is connected with the third node, and a second electrode of the eleventh transistor is connected with the first shift node;

a gate electrode of the twelfth transistor is connected with the first shift node, a first electrode of the twelfth transistor is connected with the first power terminal, and a second electrode of the twelfth transistor is connected with the first shift signal output terminal;

a gate electrode of the thirteenth transistor is connected with the (i+1)-th clock signal terminal, a first electrode of the thirteenth transistor is connected with the (i−1)-th shift node, and a second electrode of the thirteenth transistor is connected with the second power terminal;

a gate electrode of the fourteenth transistor is connected with the (i+1)-th clock signal terminal, a first electrode of the fourteenth transistor is connected with the (i−1)-th shift signal output terminal, and a second electrode of the fourteenth transistor is connected with the second power terminal;

a gate electrode of the fifteenth transistor is connected with the (i+1)-th clock signal terminal, a first electrode of the fifteenth transistor is connected with the third node, and a second electrode of the fifteenth transistor is connected with the i-th shift node; and a gate electrode of the sixteenth transistor is connected with the i-th shift node, a first electrode of the sixteenth transistor is connected with the i-th shift signal output terminal, and a second electrode of the sixteenth transistor is connected with the first power terminal.

8. The shift register according to claim 7, wherein all the first transistor to the sixteenth transistor are N-type thin film transistors; or all the first transistor to the sixteenth transistor are P-type thin film transistors.

9. The shift register according to claim 1, wherein a frequency of a pulse signal inputted into the second signal input terminal is m times of a frequency of each signal inputted into the first clock signal terminal to the (i+1)-th clock signal terminal.

10. A gate driving circuit, comprising: a plurality of cascaded shift registers according to claim 1; wherein:

a first signal input terminal of a first stage of the shift registers is connected with an initial signal input terminal, and a first signal input terminal of an (N+1)-th stage of the shift registers is connected with a first signal output terminal of an N-th stage of the shift registers, N being an integer greater than or equal to 1;

a second signal input terminal of an odd-numbered stage of the shift registers is connected with an external first input terminal, and a second signal input terminal of an even-numbered stage of the shift registers is connected with an external second input terminal;

a third signal input terminal of the N-th stage shift register is connected with a first shift signal output terminal of the (N+1)-th stage shift register;

a first clock signal terminal of the odd-numbered stage shift register is connected with an external first clock signal line, a second clock signal terminal of the odd-numbered stage shift register is connected with an external second clock signal line, and a third clock signal terminal of the odd-numbered stage shift register is connected with an external third clock signal line;

a first clock signal terminal of the even-numbered stage shift register is connected with the external third clock signal line, a second clock signal terminal of the even-numbered stage shift register is connected with an external fourth clock signal line, and a third clock signal terminal of the even-numbered stage shift register is connected with the external first clock signal line; and signals inputted into the first input terminal and the second input terminal are pulse signals with opposite phases, frequencies of the signals inputted into the first input terminal and the second input terminal are both f and a frequency of each clock signal inputted into the first clock signal line, the second clock signal line, the third clock signal line and the fourth clock signal line is m*f, where m is the number of stages of outputs of the shift output sub-circuit comprised in each stage of the shift registers.

11. The gate driving circuit according to claim 10, wherein the input sub-circuit comprises: a first transistor, a second transistor, and a third transistor, wherein:

a gate electrode of the first transistor is connected with the first clock signal terminal, a first electrode of the first transistor is connected with the first signal input terminal, and a second electrode of the first transistor is connected with the second node;

a gate electrode of the second transistor is connected with the first clock signal terminal, a first electrode of the second transistor is connected with the second node, and a second electrode of the second transistor is connected with the first node; and a gate electrode of the third transistor is connected with the first node, a first electrode of the third transistor is connected with the first power terminal, and a second electrode of the third transistor is connected with the second node.

12. The gate driving circuit according to claim 10, wherein the output sub-circuit comprises: a fourth transistor, a fifth transistor, a first capacitor, and a second capacitor, wherein:

a gate electrode of the fourth transistor is connected with the first node, a first electrode of the fourth transistor is connected with the second signal input terminal, and a second electrode of the fourth transistor is connected with the first signal output terminal;

a gate electrode and a first electrode of the fifth transistor are connected with the first node, and a second electrode of the fifth transistor is connected with the third node;

one end of the first capacitor is connected with the first node, and the other end of the first capacitor is connected with the first signal output terminal; and one end of the second capacitor is connected with the third node, and the other end of the second capacitor is connected with the second power terminal.

13. The gate driving circuit according to claim 10, wherein the reset sub-circuit comprises: a sixth transistor, a seventh transistor, an eighth transistor, a ninth transistor, and a tenth transistor, wherein:

a gate electrode of the sixth transistor is connected with the third signal input terminal, a first electrode of the sixth transistor is connected with the first node, and a second electrode of the sixth transistor is connected with the second node;

a gate electrode of the seventh transistor is connected with the third signal input terminal, a first electrode of the seventh transistor is connected with the second node, and a second electrode of the seventh transistor is connected with the second power terminal;

a gate electrode of the eighth transistor is connected with the third signal input terminal, a first electrode of the eighth transistor is connected with the third node, and a second electrode of the eighth transistor is connected with the second power terminal;

a gate electrode of the ninth transistor is connected with the third signal input terminal, a first electrode of the ninth transistor is connected with the m-th shift node, and a second electrode of the ninth transistor is connected with the second power terminal; and a gate electrode of the tenth transistor is connected with the third signal input terminal, a first electrode of the tenth transistor is connected with the m-th shift signal output terminal, and a second electrode of the tenth transistor is connected with the second power terminal.

14. The gate driving circuit according to claim 10, wherein the first shift output sub-circuit comprises: an eleventh transistor and a twelfth transistor, wherein:

a gate electrode of the eleventh transistor is connected with the second clock signal terminal, a first electrode of the eleventh transistor is connected with the third node, and a second electrode of the eleventh transistor is connected with the first shift node; and a gate electrode of the twelfth transistor is connected with the first shift node, a first electrode of the twelfth transistor is connected with the first power terminal, and a second electrode of the twelfth transistor is connected with the first shift signal output terminal.

15. The gate driving circuit according to claim 10, wherein the i-th shift output sub-circuit comprises: a thirteenth transistor, a fourteenth transistor, a fifteenth transistor, and a sixteenth transistor, wherein:

a gate electrode of the thirteenth transistor is connected with the (i+1)-th clock signal terminal, a first electrode of the thirteenth transistor is connected with the (i−1)-th shift node, and a second electrode of the thirteenth transistor is connected with the second power terminal;

a gate electrode of the fourteenth transistor is connected with the (i+1)-th clock signal terminal, a first electrode of the fourteenth transistor is connected with the (i−1)-th shift signal output terminal, and a second electrode of the fourteenth transistor is connected with the second power terminal;

a gate electrode of the fifteenth transistor is connected with the (i+1)-th clock signal terminal, a first electrode of the fifteenth transistor is connected with the third node, and a second electrode of the fifteenth transistor is connected with the i-th shift node; and a gate electrode of the sixteenth transistor is connected with the i-th shift node, a first electrode of the sixteenth transistor is connected with the i-th shift signal output terminal, and a second electrode of the sixteenth transistor is connected with the first power terminal.

16. The gate driving circuit according to claim 10, wherein the input sub-circuit comprises a first transistor, a second transistor and a third transistor, the output sub-circuit comprises a fourth transistor, a fifth transistor, a first capacitor and a second capacitor, the reset sub-circuit comprises a sixth transistor, a seventh transistor, an eighth transistor, a ninth transistor and a tenth transistor, the first shift output sub-circuit comprises an eleventh transistor and a twelfth transistor, and the i-th shift output sub-circuit comprises a thirteenth transistor, a fourteenth transistor, a fifteenth transistor and a sixteenth transistor, wherein:

a gate electrode of the first transistor is connected with the first clock signal terminal, a first electrode of the first transistor is connected with the first signal input terminal, and a second electrode of the first transistor is connected with the second node;

a gate electrode of the second transistor is connected with the first clock signal terminal, a first electrode of the second transistor is connected with the second node, and a second electrode of the second transistor is connected with the first node;

a gate electrode of the third transistor is connected with the first node, a first electrode of the third transistor is connected with the first power terminal, and a second electrode of the third transistor is connected with the second node;

a gate electrode of the fourth transistor is connected with the first node, a first electrode of the fourth transistor is connected with the second signal input terminal, and a second electrode of the fourth transistor is connected with the first signal output terminal;

a gate electrode and a first electrode of the fifth transistor are connected with the first node, and a second electrode of the fifth transistor is connected with the third node;

one end of the first capacitor is connected with the first node, and the other end of the first capacitor is connected with the first signal output terminal;

one end of the second capacitor is connected with the third node, and the other end of the second capacitor is connected with the second power terminal;

a gate electrode of the sixth transistor is connected with the third signal input terminal, a first electrode of the sixth transistor is connected with the first node, and a second electrode of the sixth transistor is connected with the second node;

a gate electrode of the seventh transistor is connected with the third signal input terminal, a first electrode of the seventh transistor is connected with the second node, and a second electrode of the seventh transistor is connected with the second power terminal;

a gate electrode of the eighth transistor is connected with the third signal input terminal, a first electrode of the eighth transistor is connected with the third node, and a second electrode of the eighth transistor is connected with the second power terminal;

a gate electrode of the ninth transistor is connected with the third signal input terminal, a first electrode of the ninth transistor is connected with the m-th shift node, and a second electrode of the ninth transistor is connected with the second power terminal;

a gate electrode of the tenth transistor is connected with the third signal input terminal, a first electrode of the tenth transistor is connected with the m-th shift signal output terminal, and a second electrode of the tenth transistor is connected with the second power terminal;

a gate electrode of the eleventh transistor is connected with the second clock signal terminal, a first electrode of the eleventh transistor is connected with the third node, and a second electrode of the eleventh transistor is connected with the first shift node;

a gate electrode of the twelfth transistor is connected with the first shift node, a first electrode of the twelfth transistor is connected with the first power terminal, and a second electrode of the twelfth transistor is connected with the first shift signal output terminal;

a gate electrode of the thirteenth transistor is connected with the (i+1)-th clock signal terminal, a first electrode of the thirteenth transistor is connected with the (i−1)-th shift node, and a second electrode of the thirteenth transistor is connected with the second power terminal;

a gate electrode of the fourteenth transistor is connected with the (i+1)-th clock signal terminal, a first electrode of the fourteenth transistor is connected with the (i−1)-th shift signal output terminal, and a second electrode of the fourteenth transistor is connected with the second power terminal;

a gate electrode of the fifteenth transistor is connected with the (i+1)-th clock signal terminal, a first electrode of the fifteenth transistor is connected with the third node, and a second electrode of the fifteenth transistor is connected with the i-th shift node; and a gate electrode of the sixteenth transistor is connected with the i-th shift node, a first electrode of the sixteenth transistor is connected with the i-th shift signal output terminal, and a second electrode of the sixteenth transistor is connected with the first power terminal.

17. The gate driving circuit according to claim 16, wherein all the first transistor to the sixteenth transistor are N-type thin film transistors; or all the first transistor to the sixteenth transistor are P-type thin film transistors.

18. A display device, comprising the gate driving circuit according to claim 10.

19. A method for driving a shift register, applied to the shift register according to claim 1, wherein the method comprises:

supplying, by the input sub-circuit, the signal of the first signal input terminal to the first node under control of the first clock signal terminal;

supplying, by the output sub-circuit, the signal of the first node to the third node and outputting the signal of the second signal input terminal to the first signal output terminal under control of the first node;

outputting, by the first shift output sub-circuit, the signal of the first power terminal to the first shift signal output terminal under control of the second clock signal terminal;

taking a value of i from 2 to m in sequence and executing processes: outputting, by the i-th shift output sub-circuit, the signal of the first power terminal to the i-th shift signal output terminal, and supplying the signal of the second power terminal to the (i−1)-th shift signal output terminal and the (i−1)-th shift node under control of the (i+1)-th clock signal terminal; and supplying, by the reset sub-circuit, the signal of the second power terminal to the first node, the third node, the m-th shift node, and the m-th shift signal output terminal under control of the third signal input terminal.

20. The method according to claim 19, further comprising:

in a first period, inputting a first-level signal to the first signal input terminal and the first clock signal terminal so that a potential of the first node and a potential of the second node are pulled to a first level by the input sub-circuit;

in a second period, inputting a first-level signal to the second signal input terminal and the second clock signal terminal, so that the first level is outputted to the first signal output terminal by the output sub-circuit in response to the potential of the first node, and a first level of the first power terminal is outputted to the first shift signal output terminal by the output sub-circuit in response to a potential of the third node;

in a third period, taking a value of i from 2 to m sequentially and executing processes: inputting a first-level signal to the second signal input terminal and the (i+1)-th clock signal terminal, so that the i-th output sub-circuit outputs a first level of the first power terminal to the i-th shift signal output terminal, and transmits a second level of the second power terminal to the (i−1)-th shift node; and in a fourth period, inputting a first-level signal to the third signal input terminal, so that potentials of the first node, the third node, the m-th shift node and the m-th shift signal output terminal are pulled to the second level of the second power terminal by the reset sub-circuit.

* * * * *